US008535102B1

(12) United States Patent
Colahan et al.

(10) Patent No.: US 8,535,102 B1
(45) Date of Patent: Sep. 17, 2013

(54) COMPLIANT MOUNT FOR CONNECTOR

(71) Applicant: Apple Inc., Cupertino, CA (US)

(72) Inventors: Ian P. Colahan, Menlo Park, CA (US); Paul J. Thompson, San Francisco, CA (US); Michael J. Webb, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/720,880

(22) Filed: Dec. 19, 2012

Related U.S. Application Data

(63) Continuation of application No. 13/607,598, filed on Sep. 7, 2012.

(51) Int. Cl.
*H01R 25/00* (2006.01)

(52) U.S. Cl.
USPC ..... 439/638; 439/929; 439/592; 439/5

(58) Field of Classification Search
USPC ..... 439/638, 5, 592, 593, 640, 929
See application file for complete search history.

(56) References Cited

U.S. PATENT DOCUMENTS

| | | | | |
|---|---|---|---|---|
| 6,049,192 | A * | 4/2000 | Kfoury et al. | 320/113 |
| 6,193,546 | B1 * | 2/2001 | Sadler | 439/534 |
| 6,290,534 | B1 * | 9/2001 | Sadler | 439/534 |
| 6,716,058 | B2 * | 4/2004 | Youn | 439/535 |
| 6,898,080 | B2 * | 5/2005 | Yin et al. | 361/679.41 |
| 6,994,575 | B1 * | 2/2006 | Clark et al. | 439/173 |
| 7,014,486 | B1 * | 3/2006 | Wu et al. | 439/248 |
| 7,066,752 | B2 * | 6/2006 | Hsu et al. | 439/248 |
| 7,238,042 | B2 * | 7/2007 | Chen et al. | 439/374 |
| 7,473,141 | B2 * | 1/2009 | Liao | 439/638 |
| 7,488,215 | B2 * | 2/2009 | Mayette et al. | 439/638 |
| 7,513,801 | B2 * | 4/2009 | Cheng et al. | 439/638 |
| 7,538,792 | B2 * | 5/2009 | Takahashi | 348/207.1 |
| 7,580,255 | B2 * | 8/2009 | Crooijmans et al. | 361/679.56 |

(Continued)

FOREIGN PATENT DOCUMENTS

| | | |
|---|---|---|
| EP | 0 755 618 B1 | 6/2000 |
| WO | 2008/039464 A1 | 4/2008 |

OTHER PUBLICATIONS

International Search Report and Written Opinion mailed on Jun. 13, 2013 for PCT Patent Application No. PCT/US2013/034597, 12 pages.

(Continued)

*Primary Examiner* — Ross Gushi
(74) *Attorney, Agent, or Firm* — Kilpatrick Townsend & Stockton LLP

(57) ABSTRACT

A compliant mount for use in a connector or connection adapter is disclosed. The compliant mount may be used in a connection between a portable electronic device and another electronic device, such as a docking station. A compliant mount connector adapter may include a first end connector engageable with a portable device and a second end connector engageable with another device, the first and second end connectors coupled with a compliant mount allowing movement of the first end connector engaged with the portable device relative to the second end connector when engaged within the other electronic device. The compliant mount may include any or all of: elastomers, springs, torsion bars, elastomers, rigid members or housing, ball and socket joints, resilient bendable members, and dongles to allow for controlled resistance to bending or torsional forces applied to the portable device when connected to the other electronic device with the connector adapter.

30 Claims, 28 Drawing Sheets

(56) References Cited

U.S. PATENT DOCUMENTS

| | | | | |
|---|---|---|---|---|
| 7,684,186 | B2 * | 3/2010 | Chang | 361/679.43 |
| 7,719,830 | B2 * | 5/2010 | Howarth et al. | 361/679.41 |
| 7,744,423 | B2 * | 6/2010 | Funahashi | 439/638 |
| 7,789,711 | B2 * | 9/2010 | Wu | 439/640 |
| 7,832,645 | B2 * | 11/2010 | Chen et al. | 235/492 |
| 7,850,484 | B2 * | 12/2010 | Hayashi et al. | 439/529 |
| 7,931,494 | B2 * | 4/2011 | Long | 439/527 |
| 7,933,117 | B2 * | 4/2011 | Howarth et al. | 361/679.41 |
| 8,083,195 | B2 * | 12/2011 | Osada | 248/274.1 |
| 8,113,873 | B1 * | 2/2012 | Sarraf | 439/533 |
| 8,139,353 | B2 * | 3/2012 | Slaby et al. | 361/679.41 |
| 8,152,561 | B2 * | 4/2012 | Long | 439/527 |
| 8,210,871 | B2 * | 7/2012 | Neu et al. | 439/569 |
| 8,323,040 | B2 * | 12/2012 | Prest | 439/131 |
| 8,355,690 | B2 * | 1/2013 | Krampf et al. | 455/349 |
| 8,366,480 | B2 * | 2/2013 | Neu et al. | 439/569 |
| 2002/0024794 | A1 * | 2/2002 | Lin et al. | 361/686 |
| 2002/0032042 | A1 * | 3/2002 | Poplawsky et al. | 455/564 |
| 2003/0008566 | A1 * | 1/2003 | Kato et al. | 439/638 |
| 2003/0017746 | A1 * | 1/2003 | Lee | 439/638 |
| 2003/0148740 | A1 * | 8/2003 | Yau et al. | 455/90 |
| 2006/0063434 | A1 * | 3/2006 | Bergmann et al. | 439/638 |
| 2006/0141856 | A1 * | 6/2006 | Chen et al. | 439/527 |
| 2006/0172607 | A1 * | 8/2006 | Bangert | 439/638 |
| 2006/0250764 | A1 * | 11/2006 | Howarth et al. | 361/683 |
| 2006/0258224 | A1 * | 11/2006 | Liao | 439/638 |
| 2006/0276083 | A1 * | 12/2006 | Sun | 439/638 |
| 2007/0153463 | A1 * | 7/2007 | Choi | 361/683 |
| 2008/0259550 | A1 * | 10/2008 | Lien | 361/683 |
| 2008/0293303 | A1 * | 11/2008 | Liao | 439/638 |
| 2009/0009957 | A1 * | 1/2009 | Crooijmans et al. | 361/686 |
| 2010/0009574 | A1 * | 1/2010 | Shi et al. | 439/638 |
| 2010/0081337 | A1 | 4/2010 | Dorogusker et al. | |
| 2011/0070757 | A1 * | 3/2011 | Krampf et al. | 439/136 |
| 2011/0070777 | A1 * | 3/2011 | Krampf et al. | 439/638 |
| 2011/0134601 | A1 * | 6/2011 | Sa | 361/679.43 |
| 2011/0250786 | A1 * | 10/2011 | Reid | 439/488 |
| 2012/0034819 | A1 * | 2/2012 | Chen | 439/638 |
| 2012/0063188 | A1 | 3/2012 | Hotta et al. | |
| 2013/0012041 | A2 * | 1/2013 | Krampf et al. | 439/136 |

OTHER PUBLICATIONS

Chinese Notice of Allowance mailed on May 22, 2013 for Chinese Patent Application No. 201320029920.7, with English translation of allowed claims, 6 pages.

Innovation Patent Certificate of Examination issued on Jun. 26, 2013 for Australian Patent Application No. 2012101888, 2 pages.

* cited by examiner

COMPLIANT MOUNT FOR CONNECTOR

CROSS-REFERENCES TO RELATED APPLICATIONS

This application is a continuation application which claims priority from U.S. patent application Ser. No. 13/607,598, filed on Sep. 7, 2012, the full disclosure of which is incorporated herein by reference.

BACKGROUND

The handheld consumer electronics market is replete with various portable electronic devices, such as cellular phones, personal digital assistants (PDAs), video games, and portable media players. Such portable electronic devices generally include a connector for connecting and mounting the devices to another electronic device, such as a docking station, a printer, sound system, a desktop computer, and the like. As new handheld devices are developed however, such devices may utilize differing types of connectors than used in other electronics devices, such that some devices may not readily connect to or be compatible with existing electronic devices. Thus, there is a continuing need for improved features and interconnection approaches that allows newer generation portable electronic devices to be used with older generation electronic devices.

SUMMARY

The present invention relates generally to compliant mounts for use with connectors of portable electronic devices and other electronic devices, and in particular compliant mounts for use with connector adapters that allow a portable electronic device to be supportably mounted to another electronic device through the adapter. In one aspect, the invention provides a compliant mount for a connector adapter that allows a portable device having a first type of connector to be connected to and supportably mounted to another electronic having a second type of connector, the first type of connector differing from the second type of connector. In another aspect, the compliant mount supports a connector in a portable or other electronic device so as to allow compliant movement of the connector relative to the device. In some embodiments, the compliant mount provides controlled bending and torsional compliance in response to movement of the portable device while mounted to another electronic device with the adapter. In another aspect, the compliant mount provides sufficient flexibility to accommodate movement in response to bending and torsional forces applied through the first connector, while providing sufficient rigidity to support the portable device when connected to the other electronic device using the adapter.

In one embodiment, the invention comprises a first end connector electrically coupled with a second end connector, the first and second end connectors coupled by a compliant mount. The mount may include one or more elastomers tuned to accommodate bending and torsional movement of the compliant mount in response to movement of the portable device when connected to another electronic device using the connector adapter. The mount may include a front elastomer nearest the first connector and an inner elastomer disposed between the front elastomer and the second end connector, the front elastomer having a hardness greater than that of the inner elastomer so as to control the location of the compliant movement in the compliant mount. In some embodiments, the first end connector includes an insertable tab portion extending distally to a plurality of electrical contacts disposed thereon for insertion into a connector receptacle of the portable electronic device, while the second end connector includes a connector receptacle for receiving an insertable tab of a connector of the other electronic device.

In some embodiments, the first end connector includes a winged-portion at a base portion of the first end connector, the winged-portion having an ellipsoid shape that extends laterally outward from an insertion axis along which the insertable tab is inserted into the portable device. The front elastomer may be configured to substantially circumscribe a base portion of the insertable tab distal of the winged-portion and abut against a distal-facing surface of the winged-portion, while the inner elastomer may be configured to circumscribe the winged-portion at the base of the first end connector proximal of the front elastomer along the insertion axis of the first end connector. The location at which the compliant movement occurs may be controlled by selecting elastomers having a particular hardness, or by selection of a ratio of hardness between the elastomers. In some embodiments, the front elastomer is of sufficient hardness to move a pivot point at which compliant movement occurs in response to bending forces proximal of the front elastomer at or near the inner elastomer.

In another aspect, the compliant mount may include various other components to guide or control the compliant movement of the mount in response to torsional or bending forces applied to the connector adapter, such components may include: elastomers, springs, rigid members or housings, spherical members, torsion bars, or removable dongles, as described in further detail herein. Any or all of the features of the embodiments described herein may be used or combined in various ways to provide controlled compliant movement so as to accommodate bending and/or torsional forces resulting from use of the device.

In one aspect, the compliance mount coupling the first and second end connector may include one or more elastomers selected to accommodate a range of bending and/or torsional movement in response to forces applied to either the first or second end connector. The one or more elastomers may be selected so as to control the amount of bending or torsional forces allowed while maintaining the integrity of the electrical connection and mounting support provided by the adapter. The elastomers may be configured in any size or shape suitable for incorporated into the compliant mount and may comprise a silicone, polyethylene, or any elastomeric material having the desired flexure and rigidity. The elastomers may be pre-fabricated and mechanically fastened to the components of the connector adapter, may be overmolded over various assembled components within the connector adapter, or may include a combination of overmolded and pre-fabricated elastomer components. This use of elastomers may be incorporated within any of the connector adapter embodiments described herein.

In some embodiments, the range of compliance may be controlled by selecting one or more elastomers selected having a particular shore hardness, such as a shore hardness within a range of shore 27 D and 72 D. In addition, the compliance movement may be further tuned by selecting two or more elastomers having differing shore hardness, such that combining the differing elastomers controls a location of where the compliant movement occurs within the connector adapter. In some embodiments, elastomers having differing hardness values are selected from a group of hardness values including shore hardness values of 27 D, 41 D, and 72 D. Furthermore, the one or more elastomers may also be configured, such as by shape, thickness or position, so as to direct and control the movement of the compliant adapter in response to the bending and/or torsional forces.

In one aspect, the compliant mount of a connector adapter includes a front elastomer near a base of the insertable tab of the first end connector and an inner elastomer between the front elastomer and the second end connector. In some embodiments, the front elastomer is selected to have a hardness greater than that of the inner elastomer so as to move a pivot point about which compliant movement occurs proximal of the first end connector along the longitudinal axis. Alternatively, using an elastomer of increased hardness level nearest the second end connector would move the compliant movement away from the second end connector. For example, the front elastomer may be selected to have a hardness between 5% and 100% greater than the inner elastomer, such as 10% to 75%, or 10 to 50% greater. In some embodiments, the compliant mount may include three or more elastomers of varying hardness levels so as to provide multiple pivot points according to differing levels of bending or torsional forces, the elastomer having increased hardness providing the secondary pivot points in response to increased levels of force. In addition, rigid members or plates attached to one or more elastomers may be used to limit the amount of compliant movement experienced within a particular elastomer so as to transfer compliant movement associated with increased levels of force into another elastomeric portion having increased hardness, thereby inhibiting overextension of any of the components. Alternatively, using an elastomer of increased hardness level nearest the second end connector would move the compliant movement away from the second end connector.

The use and advantages of using particular combinations of elastomers of differing hardness levels varies according to the desired application. Elastomers having increased hardness levels may provide greater resistance to bending or torsional stresses, while elastomers having lower hardness levels offer advantages during processes due to lower flow temperatures and reduced viscosity. Elastomers of various hardness levels may be selected according to the desired range of forces the adapter is expected to withstand without damage to the integrity of the adapter, whether cosmetic or functional.

These and other aspects and advantages of the invention will become apparent from the following detailed description and accompanying drawings which illustrate, by way of example, the principles of the invention. Various embodiments of the present invention may incorporate one or more of these and various other features described herein. A better understanding of the nature and advantages of the present invention may be gained by reference to the following detailed description and the accompanying figures.

DETAILED DESCRIPTION

Embodiments of the present invention generally relate to connector adapters that that provide an electronic connection and a compliant mount between two electronic devices. In particular, the invention includes a connector adapter having a first end connector and second end connector coupled with a compliant mount configured to accommodate bending and torsional movement in response to forces applied through the first or second end connectors In one aspect, the first end connector is of a different size or type than the second connector so that a portable device having a first type of connector can be connected and mounted to another electronic device having a second type of connector. In some embodiments, the first end connector is of a reduced size or dimension as compared to the second end connector such that the compliant mount is configured to distribute bending and/or torsional forces applied through the first connector to provide for an improved mounting and compliance between a device having a first type of connector type to a device having a second type of connector. The compliant mount may include one or more elastomers having a particular hardness to provide sufficient flexibility to accommodate a range of bending or torsional compliance while providing sufficient rigidity to maintain the electronic connection and to supportably mount the portable device with the other electronic device. These concepts can be further understood by referring to the following figures and accompanying descriptions.

Figure 1A:
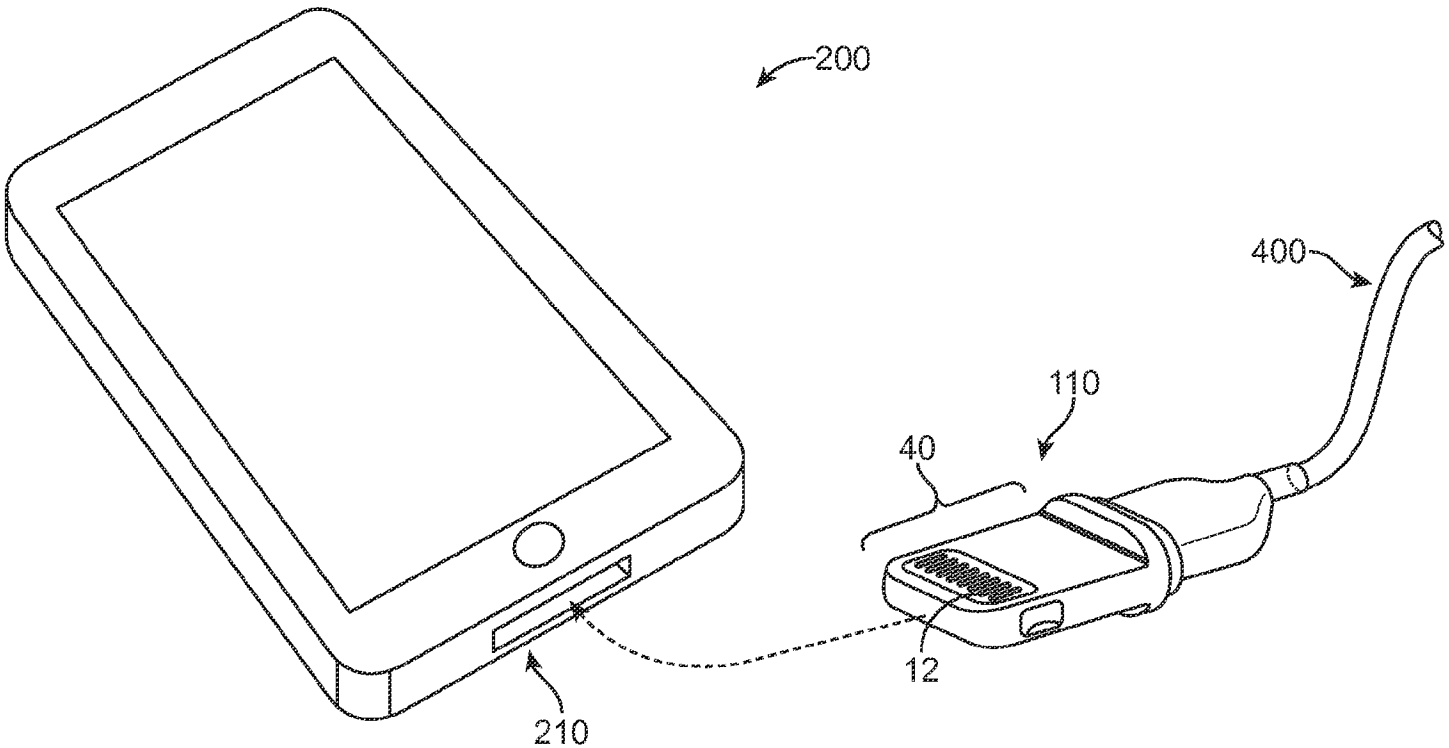
FIG. 1A shows a portable electronic device having a first connector type including a connector receptacle corresponding to an insertable connector tab of a corded connector.

FIG. 1A is an illustration of a portable electronic device 200, such as a media player, cell phone, imaging device, game player or media storage device, that may be used with a compliant connector adapter as described above. Such portable electronic devices 200 generally include a connector 210 to facilitate power supply charging and/or communication with another electronic device, such as a docking station, printer, sound system, or computer. The connector may include a connector receptacle 210 of the portable electronic device 200 that is configured to matingly engage with a corresponding connector tab 40 of connector plug 110 such that the electrical contacts 12 on connector tab 40 engage corresponding electrical contacts within the receptacle 210 when the connectors are mated. Many such devices include a corresponding insertable tab on a connector plug 110 attached to a cable 400 to facilitate connection of the portable electronic device 200 with a variety of differing devices.

Figure 1B:
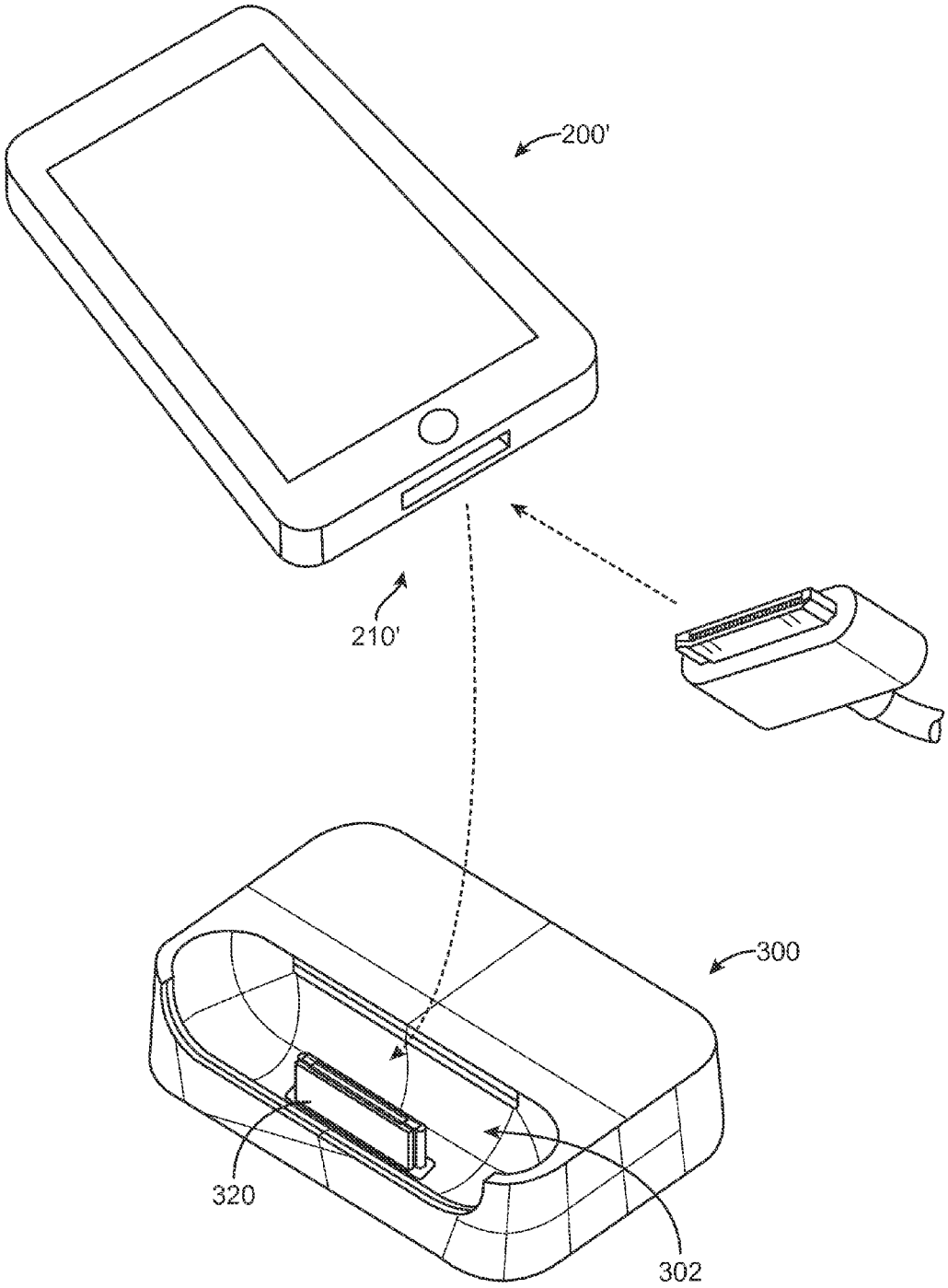
FIG. 1B shows another portable electronic device having a differently size and type of connector and a corresponding connector tab in each of a corded connector and connector of a docking station.
Figure 1C:
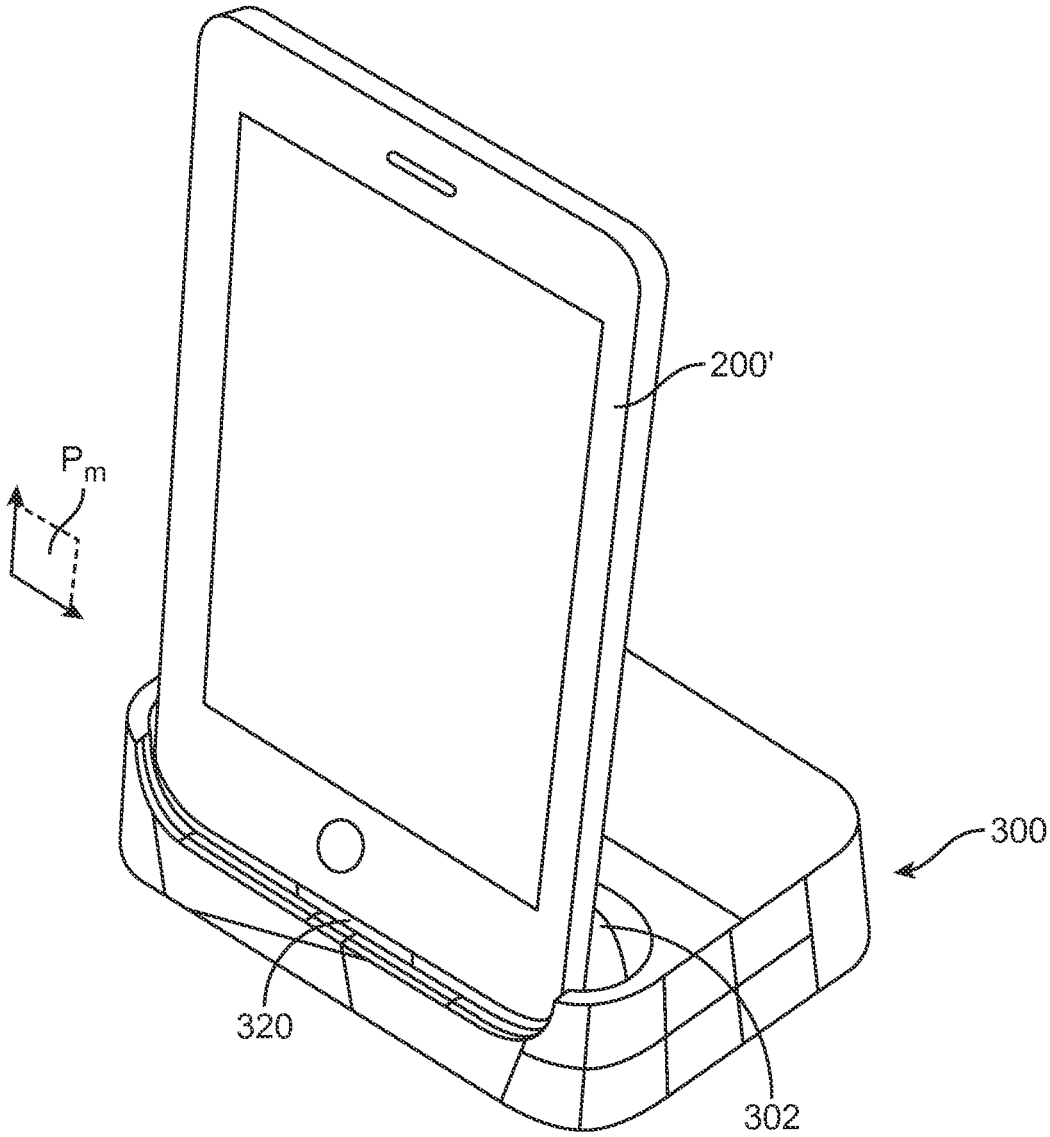
FIG. 1C shows the portable device of FIG. 1B mounted in the docking station, the insertable connector tab of the docking station matingly received within the connector receptacle of the portable device.

In many applications, however, a corresponding insertable connector tab is incorporated into another electronic device 300, such as a docking station, printer, sound system, or computer and the like, so that the portable electronic device can be connected directly to the other electronic device without the need for a cable connector therebetween, such as shown in FIG. 1C. Often a docking station of the other electronic device includes a docking well 302 from which the insertable tab of the connector protrudes, such that when the insertable tab 320 is mated within the corresponding connector receptacle 210' of the portable device, the portable device 200' is electrically coupled with the other electronic device and the portable device may be supported in a mounted position, as shown in FIG. 1C. Typically, the mounted position is within a pre-determined mounted plane Pm in which the device is in a substantially upright position to enable a user to view a display or manually operate a touchscreen of the device when connected. Although various devices include a docking well to assist in maintaining the portable device in a mounted, upright position, such docking wells may also limit the types and sizes of devices which can be docked or mounted to the other electronic device.

Since portable devices and electronic devices (e.g. docking stations), however, may use various differing types of connectors (e.g. 30-pin, 8-pin, USB, etc.) such that portable devices having differing types of connectors may not be suitable for direct connection or mounting between connectors of such devices. For example, the portable device in FIG. 1A uses a connector of a first type having a reduced size and width (e.g. an 8-pin connector) while the portable device 200' shown in FIG. 1B uses a wider connector (e.g. a 30-pin connector), such that the portable device 200 having a first type of connector 210 cannot readily be connected and mounted to an electronic device 300 having a second type of connector 320.

Although a direct adapter could conceivably be used, the increased moment arm created by the adapter as well as the change in dimensions between the differing types of connector may create undesirable increased in bending and torsional forces due in part to the change in mounting position, the weight of the portable device and forces inflicted by a user on the portable device. These increased forces may prevent a reliable connection between devices and interfere with the ability to mount the portable device with another device where connection types differ. While the devices could conceivably be connected using a corded adapter connector, using a cable connection to facilitate connection between two such devices may not provide the mounting support for which many electronic devices (e.g. docking stations) are designed. As the size and type of connector of a given portable device may change as new generations of portable devices are developed, it would be advantageous to provide a connector adapter to allow connection between a portable device having a first type of connector and another electronic device having a second type of connector. It would be further useful if such an adapter included a compliant mount to accommodate the increased bending and torsional forces that may result from use of such an adapter and to provide improved mounting support for the portable device. It would further advantageous if the adapter were configured to allow different sizes of portable devices to be connected to and mounted in an electronic device 300, even portable devices that would otherwise be too large or unsuitable for mounting directly within the other electronic device.

Figure 2A:
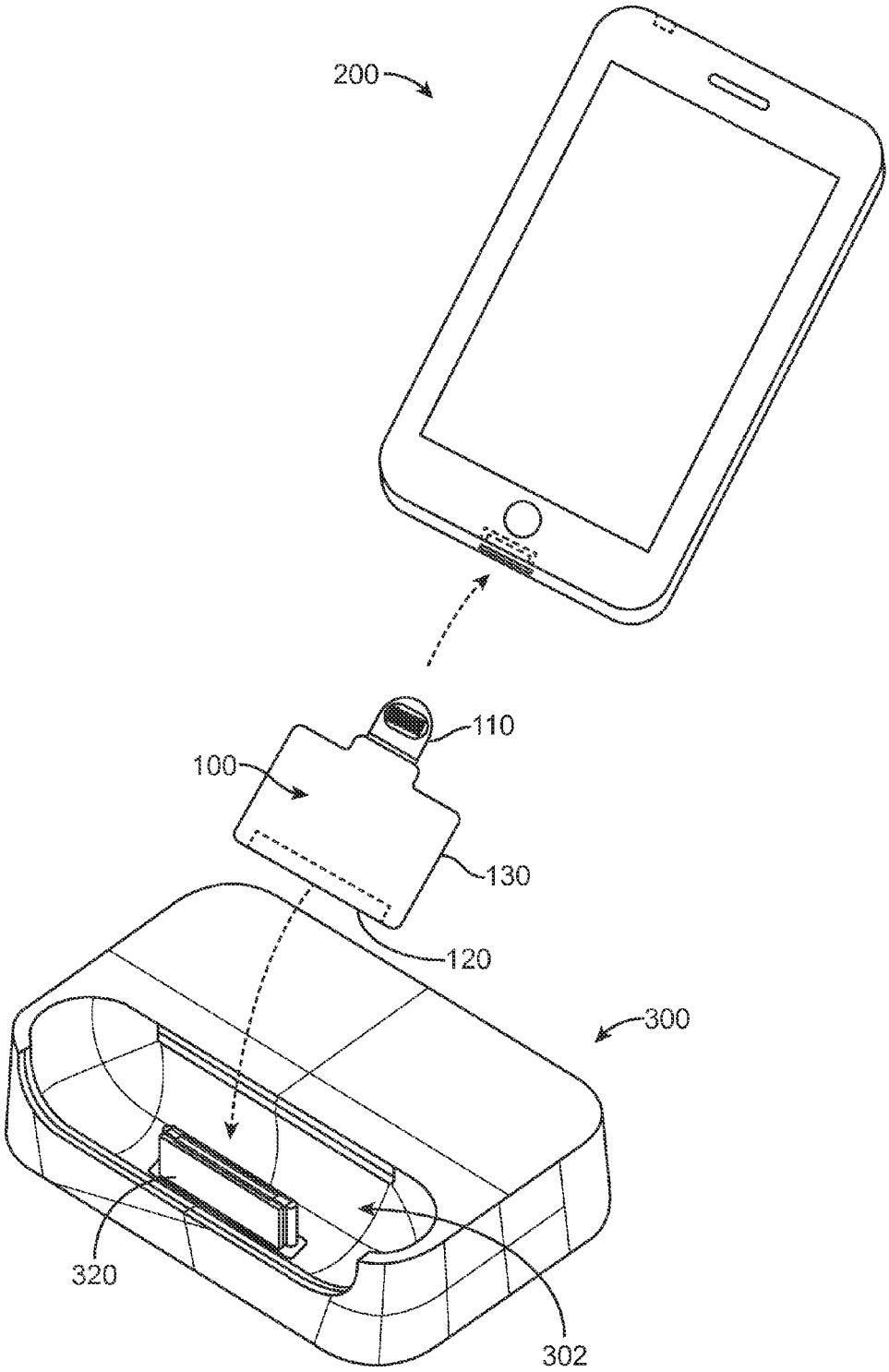
FIG. 2A shows an example compliant mount connector adapter that allows the portable device of FIG. 1A to be mountably connected in the docking station of FIG. 1B.
Figure 2B:
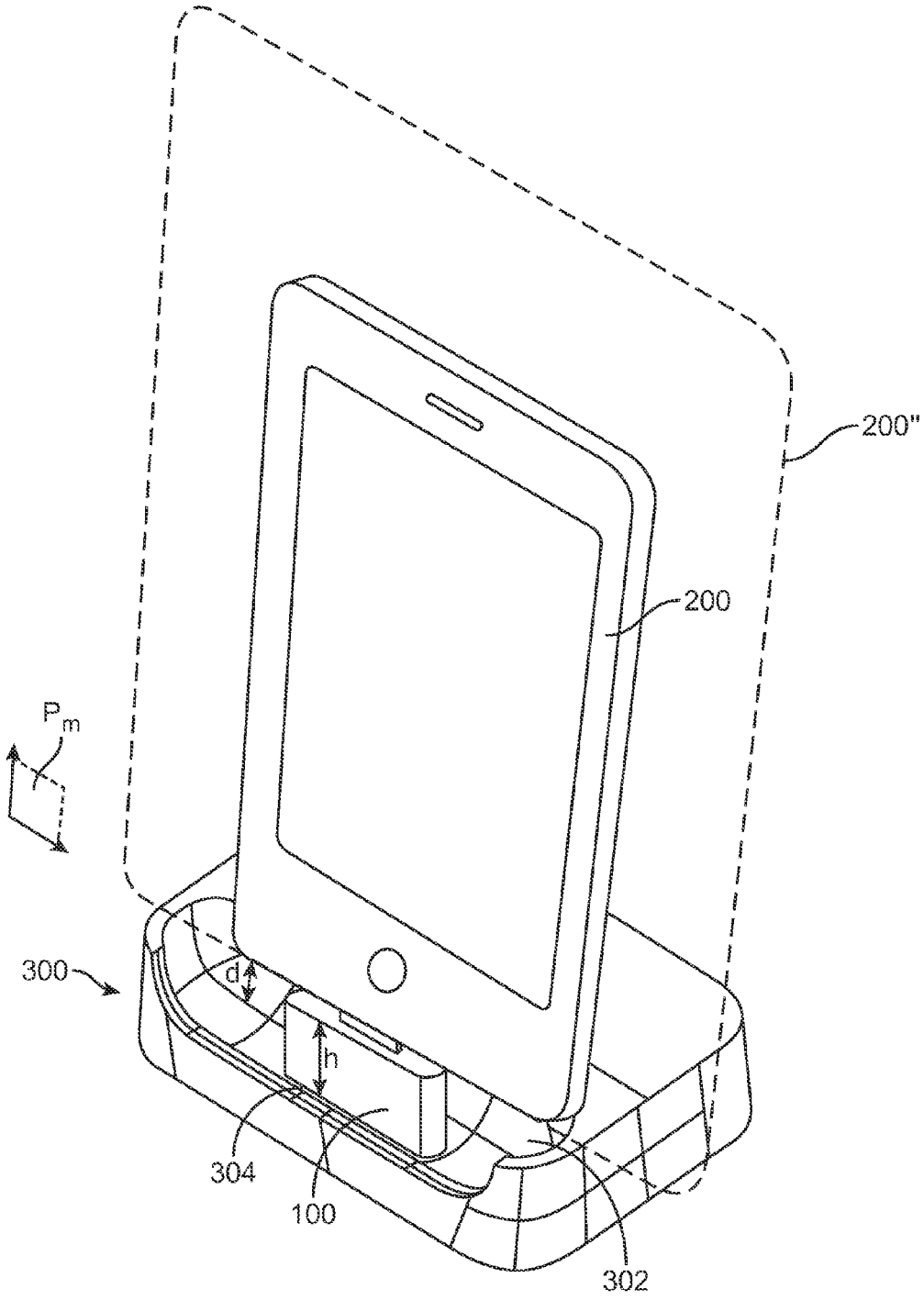
FIG. 2B shows the portable electronic device of FIG. 1A mounted in the docking station using the compliant adapter.

FIG. 2A shows a compliant connector adapter 100 in accordance with embodiments of the present invention that allow a portable electronic device 200 having a first type of connector to be connected to and mounted in another electronic device having a second type of adapter. The connector adapter includes a first end connector 110 of a first type and a second end connector 120 of the second type, the first end connector 110 being adapted for insertion into the connector 210 of the portable electronic device 200 and the second end connector 120 being adapted for matingly receiving connector 320 of the other electronic device 300. The first end connector 110 and the second end connector are electronically coupled through the adapter body and structurally coupled by a compliant mount that provides sufficient rigidity to support the portable device 200 in a mounted position as shown in FIG. 2B, while still allowing compliant movement or flexure in response to movement of the portable device 200 relative the other electronic device 300. In addition, the compliant mount may be configured or tuned to accommodate a pre-determined range of movement above which the compliant mount provides resistance to inhibit further movement beyond the pre-determined range of movement. For example, the adapter body with compliant mount may be configured to resist application of one or both of a bending forces and a torsional force due to relative movement between the portable device 200 and the other electronic device 300. These aspects allow flexibility to withstand application of forces that may be commonly encountered during use of the mounted portable device, while inhibiting movement that could potentially damage certain components of the connectors or electronic devices.

In many instances, the portable electronic device 200 is a handheld portable device that is sized for placement into a pocket of the user. By being pocket sized, the user does not have to directly carry the device and therefore the device can be taken almost anywhere the user travels (e.g., the user is not limited by carrying a large, bulky and often heavy device, as in a laptop or notebook computer). Often a user may wish to connect and mount the portable device to another device to facilitate charging of the power supply of the device or communication with the device to upload or download data from the device. For example, in the case of a portable music player device, the user may wish to mount and connect the device, such as an IPod, to a sound system, many such sound systems including a docking well with a protruding connector. When connected with the protruding connector, the portable music player is typically supported by the protruding connector in the upright position described above. Many such portable devices are pocket sized having a width of about 2-4 inches, a height of about 4-6 inches and depths ranging from about 0.5 to 1 inch, and the docking wells are designed accordingly. Although the docking wells assist in maintaining the portable device in a mounted, upright position, such docking wells may also limit the types and sizes of devices which can be docked or mounted to the other electronic device. In some embodiments, the connector adapters may be sized and adapted to extend above the bottom surface of a docking well so as to allow connection and mounting of portable devices that would not otherwise fit within the docking well. For example, an iPad or other such device larger than a typical handheld portable device may be mounted in a docking station having a docking well sized to receive typical handheld portable devices. For example, as indicated in FIG. 2B, a connector adapter having a height (h) about the same or greater than a depth (d) of the docking well, allows a relatively large portable device 200" (shown in dashed line) to be connected to the electronic device 300; however, when connecting relatively large portable devices, an additional prop or support may be needed to fully support the devices, which in some embodiments may be incorporated into the adapter body.

Despite the above noted advantages of the connector adapter, there are additional challenges associated with use of a connector adapter to connect and mount a portable device to another electronic device. Since the connector adapter extends a distance away from the connector of the other electronic device, the resulting increased moment arm and decreased dimensions of the first end connector considerably increase the stresses and forces experienced by the first end connector, which can be more difficult to counter given the decreased dimensions of the first end connector. The compliant connector adapter described herein addresses these challenges by utilizing various designs and configurations of compliant mounts that allow the connector adapter to provide a range of compliant movement in response to these forces while maintaining the electronic connection between the devices and the mounting support of the portable device.

Figure 2C:
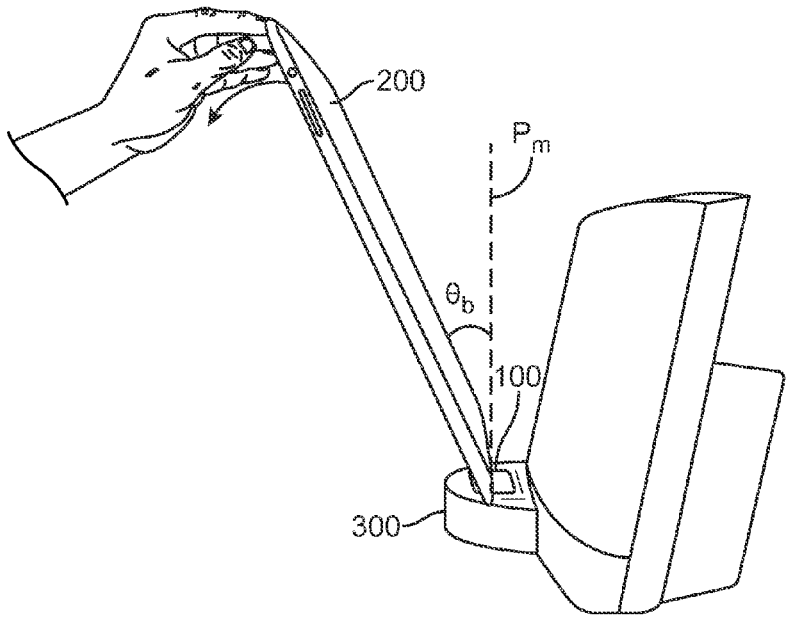
FIG. 2C depicts bending on the adapter by out-of-plane movement of the portable device when mounted in the docking station.
Figure 2D:
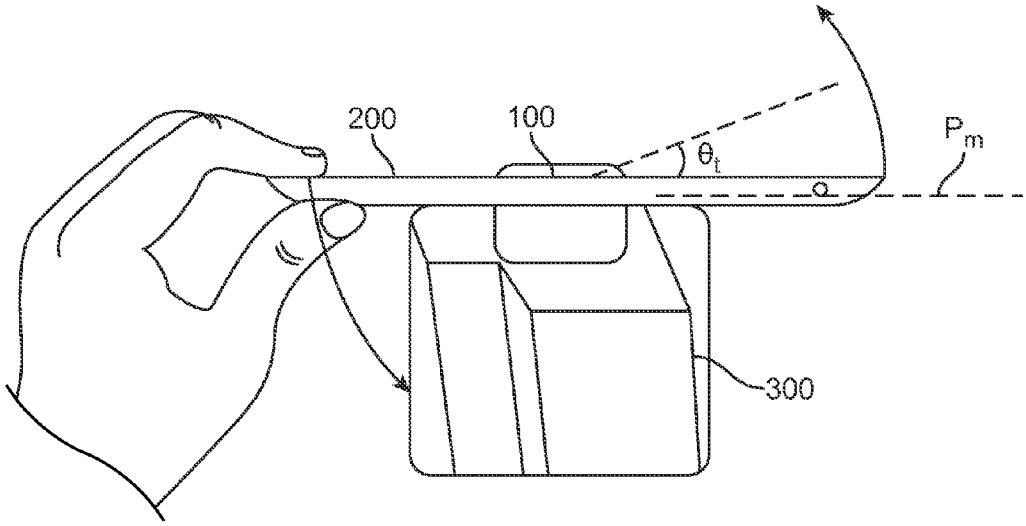
FIG. 2D depicts torsional forces applied on the adapter by rotational or twisting movement of the portable device when mounted in the docking station.

FIGS. 2C and 2D illustrate some of the bending and torsional forces that may be experienced by the compliant mount connector adapter 100 during typical use of the device. In FIG. 2C, a user may inadvertently or purposefully move the portable device 200 away from the mounted plane Pm in which the portable extends when supportably mounted in a non-displaced position. The compliant mount coupling the first and second end connectors in the connector adapter may be configured to withstand a range of bending movements as desired that result from out-of-plane movement of the portable device. This out-of-plane movement of the portable device and first end connector may be expressed as an angular displacement, θb, measured from the non-displaced mounted plane Pm, the pivot point of such movement occurring within the compliant adapter. The location of the pivot point may be adjusted or controlled by material selection of the compliant mount components or by the dimensions and configuration of the compliant mount components within the connector adapter. In some embodiments, the compliant mount is configured to withstand bending movement associated with θb within a range of between +/0° and +/−90° (e.g. +/5° and +/−80°) before sustaining damage, cosmetic or structural. The compliant mount may also be configured so as to pop-off or release from the connector of the other electronic device at a certain θb, so as to prevent damage of either connector or the adapter itself. The first or second connector may release merely due to the stiffness of the compliant mount or may include a mechanism by which a retention mechanism coupling either the first or second connector to the corresponding connectors of the devices effects release of the connector at the desired displacement, such as at an θb of about 60°.

As shown in FIG. 2D, movement of the portable device 200 may also include rotation of the portable device at an angular displacement θt away from the mounted plane Pm. Similar to the bending displacement described above, the compliant mount components within the connector adapter may be configured to withstand and/or respond to a range of angular displacements, θt, before sustaining any damage, whether cosmetic or structural, or before releasing the adapter at either connector. As can be understood with reference to FIG. 2D, the pivotal axis about which the portable device rotates extends through the connector adapter. The location of this axis as well as the level of compliance and resistance can be controlled by material selection as well as the dimensions and configuration of the compliant mount components. In some embodiments, the compliant mount is configured to withstand bending movement associated with θt within a range of between +/0° and +/−90° (e.g. +/5° and +/−40° before sustaining damage, cosmetic or structural. The compliant mount may also be configured so as to pop-off or release from the connector of the other electronic device at a certain θt, so as to prevent damage of either connector or the adapter itself. The first or second connectors may release merely from the stiffness of the compliant mount or by a mechanism which releases a retention mechanism coupling either the first or second connector to the corresponding connectors of the devices to effect release of the adapter from either connector at the desired rotational displacement, such as at an θt of about 60°.

Figure 3A:
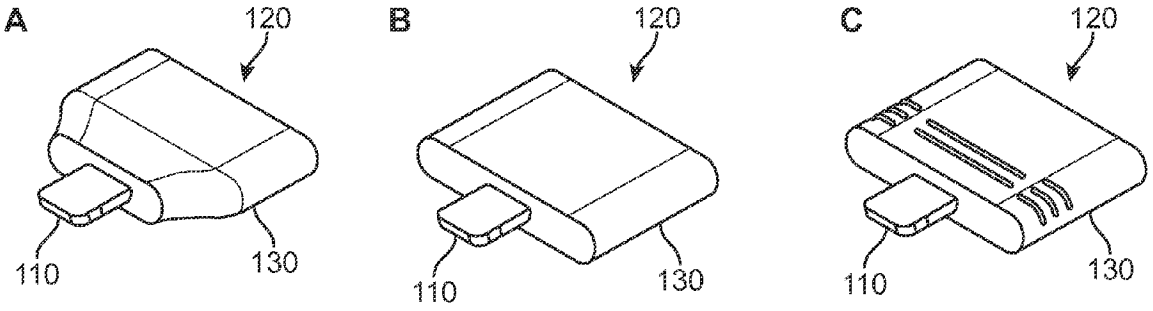
FIGS. 3A-3E shows example compliant adapters and corresponding components for use with such example compliant adapters.

FIG. 3A shows three different embodiments of example compliant mount connector adapters in accordance with the invention, each having a differing shape (shapes A, B and C), each shape compatible with certain constructions and variations, as will be described in further detail. Each compliant mount connector adapter 100 includes a first end connector 110 electrically connected to a second end connector 120 (not visible) by a compliant electrical coupling (not visible) that can accommodate the compliance provided by the compliant mount. In the embodiments shown, the first end connector 110 is of a different type than the second end connector 120, such that the first end connector 110 has fewer electrical contacts and a reduced overall size as compared to the second end connector 120. Although in the embodiments described herein, the first end connector 110 is reduced in size as compared to the second end connector, it is understood that the first end connector may be larger than the second end connector or that the connectors may be of the same type or size and still allow for many of the advantages of the connector adapter described herein.

Figure 3B:
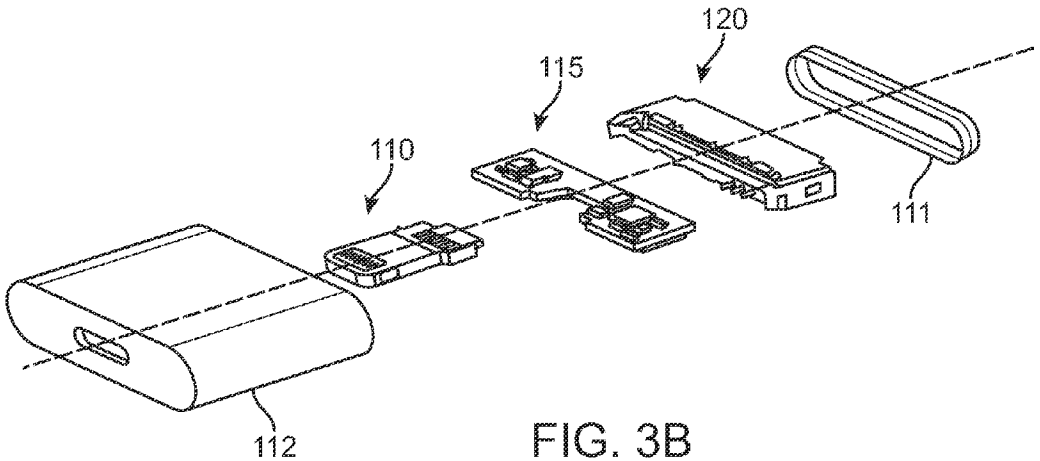

FIG. 3B illustrates an exploded view of an example compliant mount connector adapter 100, the component shown separated along the device's longitudinal axis. In this embodiment, the first end connector 110 is of a connector type of reduced size and having eight electrical contacts dispose thereon, while the second end connector 120 is an elongated 30-pin receptacle. The first end connector 110 and second end connector 120 are connected by a compliant connection through a printed circuit board component 115, configured to allow communication between the differing types of end connectors. Once connected, the components are covered by an adapter body housing 112 that that may include an end collar 111 to secure the adapter components together. Although in this embodiment, the housing 112 is shown as a shell, it is appreciated that in some embodiments the adapter may or may not include a housing and various other components may be included therein.

Figure 3C:
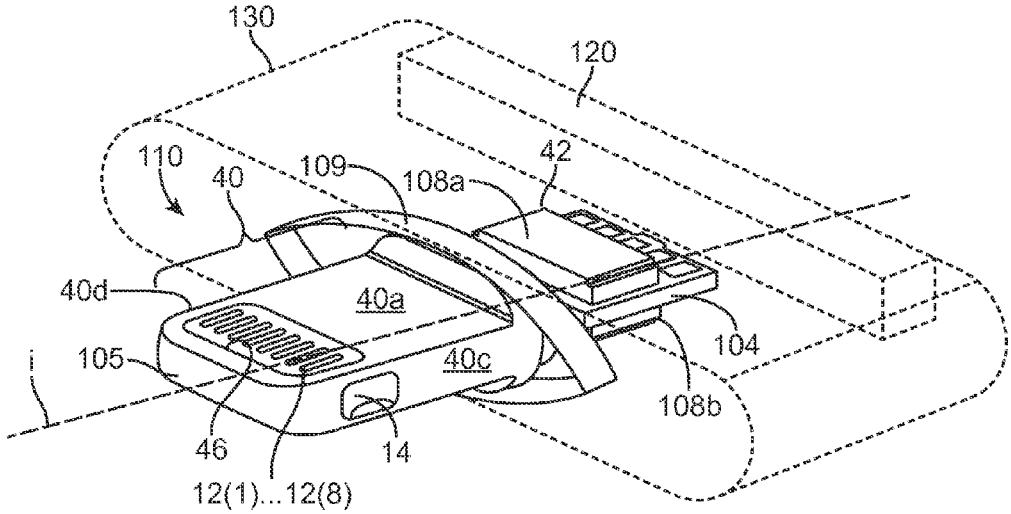
Figure 3D:
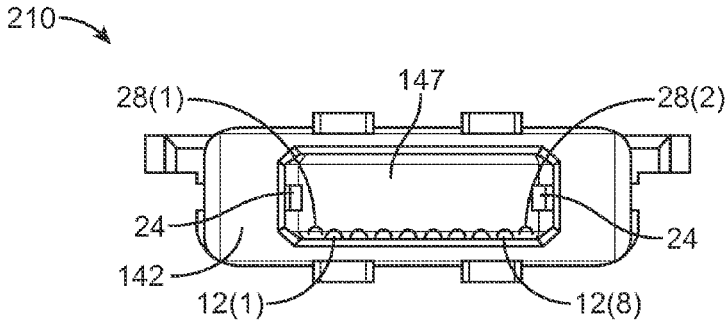

FIGS. 3C-D illustrate an example connector tab 40 of the first end connector 110 of the connector adapter 100 of FIGS. 3A-3B. FIG. 3C depicts the insertable tab 40 of the male connector plug 110. Connector plug 10 includes a first connector body 42 and the tab portion 40 that extends longitudinally away from a proximal printed circuit board component 42 along a longitudinal axis of the connector 110. In this embodiment, the first connector plug 110 is coupled to the second connector receptacle (not shown). As shown, body 42 includes a printed circuit board 104 that extends into ground ring 105 towards the distal tip of connector 110. One or more integrated circuits (ICs), such as Application Specific Integrated Circuit (ASIC) chips 108*a* and 108*b*, can be operatively coupled to printed circuit board 104 to provide information regarding connector 110 to perform specific functions, such as authentication, identification, contact configuration and current or power regulation.

In the above embodiment, tab 40 is sized to be inserted into a corresponding connector receptacle 210 of an electronic device during a mating event and includes a contact region 46 formed on a first major surface 40*a* extending from a distal tip of the tab to a winged-portion 109 such that when tab 40 is inserted into the connector receptacle 210, the winged-portion 109 (or an elastomer disposed thereon) abuts against a housing of the portable electronic device surrounding the connector receptacle. In one particular embodiment, insertable tab 40 is 6.6 mm wide, 1.5 mm thick and has an insertion depth (the distance from the tip of tab 40 to winged-portion 109) of 7.9 mm. Tab 40 may be made from a variety of materials including metal, dielectric or a combination thereof. For example, tab 40 may be a ceramic base that has contacts printed directly on its outer surfaces or may include a frame made from an elastomeric material that includes flex circuits attached to the frame. In some embodiments, tab 40 includes an exterior frame made primarily or exclusively from a metal, such as stainless steel, with a contact region 46 are formed within an opening of the frame. Typically, the structure and shape of tab 40 is defined by a ground ring 105 and can be made from stainless steel or another hard conductive material, although the construction of the tab 40 may be varied, such as through the use of flexible conductive materials or conductive elastomers, to provide additional compliance as desired.

In some embodiments, the winged-portion 109 may be fabricated to extend laterally outward in each direction substantially perpendicular to the longitudinal axis of the connector adapter, shown in FIG. 3C as an oval or ellipsoid shape with pointed ends that extends around the base of the first end connector 110. This winged-portion 109 may be formed integrally with the ground ring 105, or may be coupled to the ground ring such as by a weld or other suitable mechanical coupling. By extending laterally outward, the winged-portion 109 transfers forces applied through the insertable tab outward so as to allow an increased area by which the compliant mount can accommodate and/or counter the applied forces. For example, the winged portion 109 may distribute forced applied through a first end connector 110 having a reduced width over an increased width to distribute the applied forces more evenly to the second connector having a greater width, thereby taking advantage of any compliance or flexibility associated with second connector tab of the other electronic device. To provide this distribution of force, the winged-portion 109 may be fabricated to be substantially rigid, although in other embodiments, the winged-portion 109 may be configured accordingly to include varying levels of flexure or compliance.

In this embodiment, contact region 46 is centered between the opposing side surfaces 40*c* and 40*d*, and a plurality of external contacts are shown formed on the top outer surface of tab 40 within the contact region. The contacts can be raised, recessed or flush with the external surface of tab 40 and positioned within the contact region such that when tab 40 is inserted into a corresponding connector receptacle they can be electrically coupled to corresponding contacts in the connector receptacle. The contacts can be made from copper, nickel, brass, stainless steel, a metal alloy or any other appropriate conductive material or combination of conductive materials. In some embodiments contacts can be printed on surfaces 40*a* using techniques similar to those used to print contacts on printed circuit boards. In some other embodiments the contacts can be stamped from a lead frame, positioned within regions 46 and surrounded by dielectric material.

In an exemplary embodiment, the connector tab 40 may also include one or more retention features 14 corresponding to one or more retention features within the receptacle 20.

For example, the retention features of the tab 40 may include one or more indentations, recesses, or notches 14 on each side of tab 40 that engage with corresponding retention feature(s) 24 within the receptacle, the corresponding retention feature(s) 24 extending or protruding toward the insertion axis along which the connector tab 40 is inserted so as to be resiliently received within the indentation, notch or recess within the sides of tab 40. In one particular embodiment, retention features 14 are formed as curved pockets or recesses in each of opposing side surfaces 40*c*, 40*d*, the shape and location of the retention features 14 corresponding to complementary retention features 24 in the receptacle when in a mated configuration. Generally, the retention features 24 of the receptacle resemble spring-like arms configured to be resiliently received within the recesses 14 once the connector plug 10 and receptacle 20 are properly aligned and mated. The engagement of these resilient retention features of the receptacle and the retention feature within the tab can be seen in more detail in FIG. 3C.

In some embodiments, one or more ground contacts can be formed on tab 40, or may include on an outer portion of tab 40. In many embodiments, the one or more ground contacts are formed within and/or as part of a pocket, indentation, notch or similar recessed region 14 formed on each of the side surfaces 40*c*, 40*d* (not shown in FIG. 3*a*), such that the retention feature 14 may also act as the electrical ground for tab 40.

FIG. 3D depicts a connector receptacle 20 in accordance with many embodiments. The connector receptacle 20 also includes side retention mechanisms 24 that engage with corresponding retention features 14 on connector plug 10 to secure connector plug 10 within cavity 147 once the connectors are mated. In many embodiments, the retention mechanisms 24 are resilient members or springs, often formed from an elongated arm that extends from a rear portion of the receptacle and extends toward the opening of cavity 147, such as shown in more detail in FIG. 3C. The retention mechanisms 24 may be made from an electrically conductive material, such as stainless steel, so that the feature can also function as a ground contact. The connector receptacle 20 may also include two contacts 28(1) and 28(2) that are positioned slightly behind the row of signal contacts and can be used to detect when connector plug 10 is inserted within cavity 147 and/or when connector plug 10 exits the cavity 147. When tab 40 of connector plug 10 is fully inserted within cavity 147 of connector receptacle 20 during mating between the plug and connector receptacles, each of contacts 12(1) . . . 12(8) from one of contact region 46 are physically coupled to one of contacts 22(1) . . . 22(8).

Figure 3E:
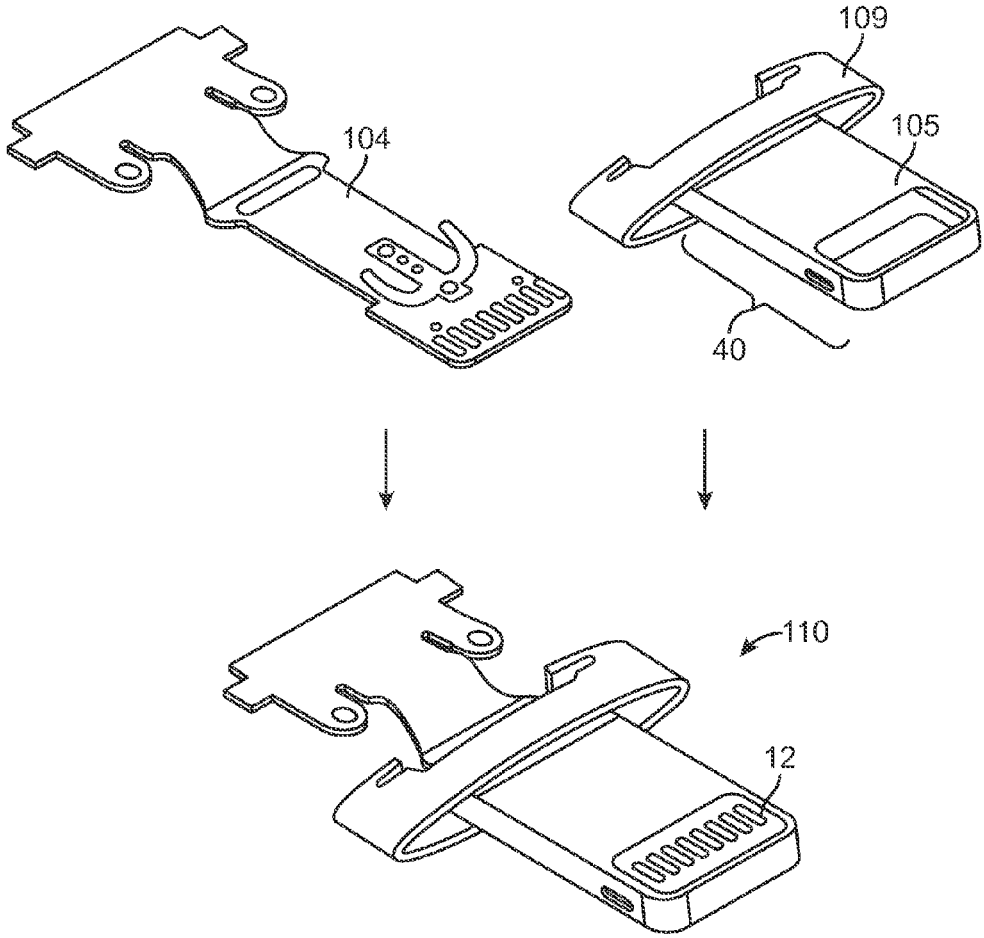

FIG. 3E depicts assembly of an example first end connector for use with a compliant mount connector adapter. The hollow ground ring 105 of the connector is fabricated from stainless steel, a distal portion of the ground ring defining a cavity for assembly of the plurality of electrical contacts on a printed circuit board 104 inserted from a distal rear portion of the ground ring 105. A distal portion of the ground ring is fabricated to include a winged-portion 109 resembling an ellipsoid shape with pointed ends that extends laterally outward from the base of the insertable tab 44. A distal portion of the printed circuit board includes a plurality of pad for bonding to a plurality of electrical contacts 12 placed in contacts with the pads, after which an overmold is applied to secure the electrical contacts 12 in place and provide a flush contact surface by which the insertable tab interfaces with the connector receptacle of the portable device 200.

Figure 4A:
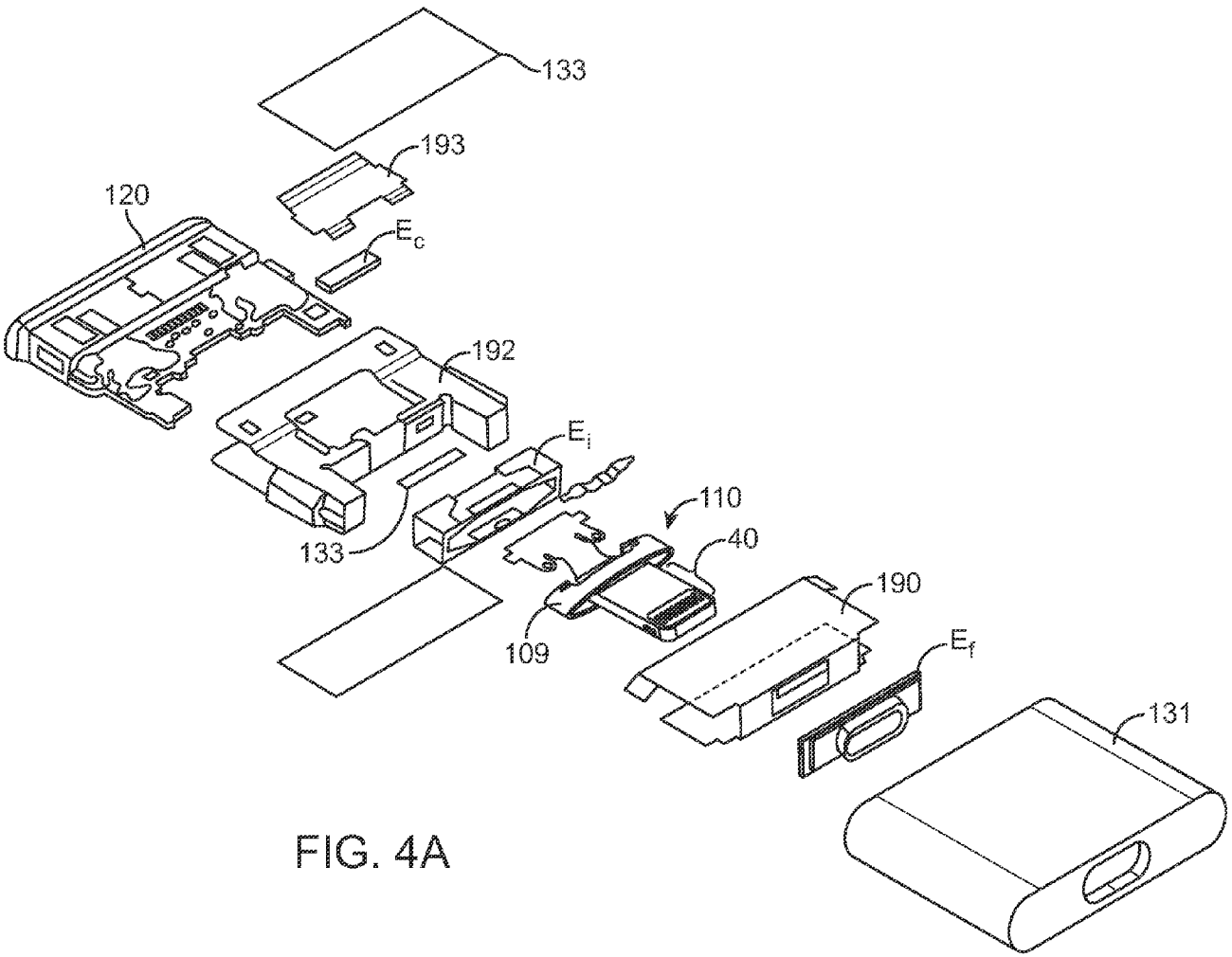
FIG. 4A shows an exploded view of a compliant mount connector adapter.

FIG. 4A depicts an exploded view of an example compliant mount connector adapter 100. The embodiment in FIG. 4A uses elastomers to provide bending and torsional compliant movement. As described above, one or more elastomers of differing hardness may be used to provide increased control of compliant movement within the connector adapter. The compliant mount includes a front elastomer, Ef, that slides over the insertable tab 40 and abuts against the winged-portion 109 of the ground ring 105 and an inner elastomer, Ei, that slides over the winged-portion 109 of the ground ring. By selecting an front elastomer Ef having a hardness greater than the inner elastomer Ef, the compliant movement of the elastomers is moved predominately to the inner elastomer, Ei, such that the pivot point about which compliant movement occurs in response to bending forces occurs proximal of the front elastomer. The front elastomer may be configured to extend laterally outward so as to abut against a front facing or distal facing surface of winged portion 109, while the inner elastomer, Ei, is configured to fittingly receive the winged-portion 109. The front elastomer may be selected to have a hardness between 5% and 100% greater than the inner elastomer, such as 10% to 75%, or 10 to 50% greater than the inner elastomer, Ei, so as to move the pivot point about which the compliant mount bends to the more flexible elastomer, which is the elastomer having the lower hardness level.

In another aspect, the compliant mount connector adapter includes an electromagnetic interference shield surrounding the printed circuit board components of each of the first and second end connectors. As shown in the embodiment of FIG. 4A, the shield may comprise a slide-on shield, such as shield 192 configured to slide over the second end connector receptacle 120, or the shield may comprise a thin metallic layers adhesively applied to one or more elastomers, such as shield 190 which comprises a piece of copper tape adhesively applied to the inner elastomer Ei so as to shield the printed circuit board of the first end connector. The use of metallic tape, such as in shield 190 is advantageous as it allows for increased flexibility where compliant movement occurs within the connector adapter. The assembly of such a shield is described further in FIGS. 4B-4C.

The compliant mount connector adapter may also include one or more shims, such as shims 133 disposed on opposing sides of the shield 192 in FIG. 4A. The one or more shims may be configured to provide additional support and/or rigidity within the adapter body housing 131 as the compliant mount flexes in response to bending and/or torsional stresses. The shims may be used to prevent spaces or gaps between the housing and the internal components during flexure so as to inhibit cosmetic or structural damage to the connector adapter housing 131.

Figure 4C:
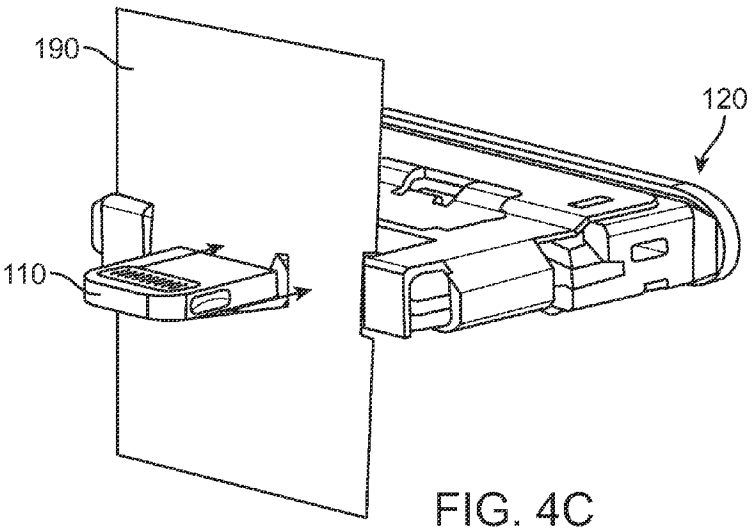
FIGS. 4B-4D show steps of assembly of the compliant adapter of FIG. 4A.
Figure 4D:
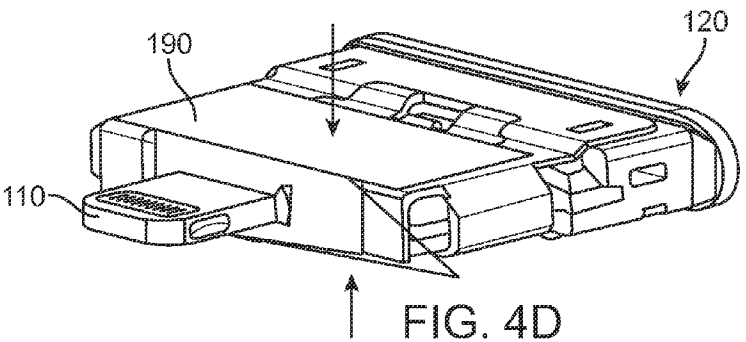
Figure 4B:
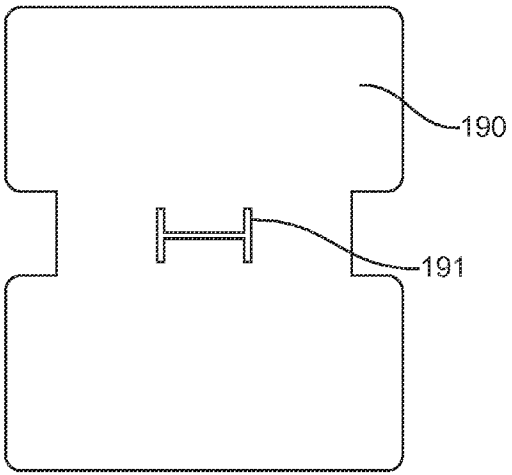
Figure 4B:
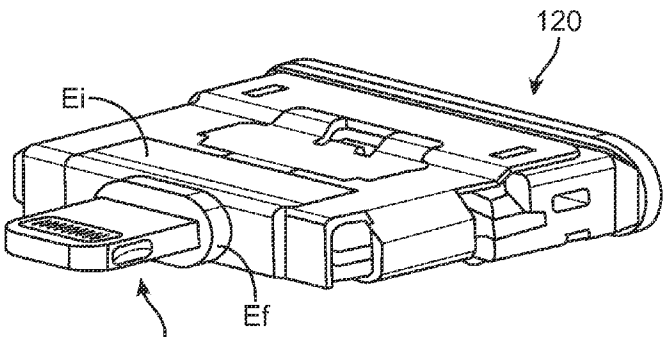

FIGS. 4B-4D illustrate assembly of the shield 190 to the elastomeric components surrounding first end connector 110. Once the first end connector and second end connector are assembled, as shown in FIG. 4B, the inner elastomer, Ei circumscribing the winged-portion 109, and the front elastomer, Ef, abutted against the front facing surface of winged-portion 109, a piece of copper tape 190, as shown in FIG. 4B can be applied as shield about the first end connector 110. The copper tape 190 may include a perforated or scored opening 191 in the center through which the insertable tab 40 of first end connector 110 can be inserted, as shown in FIG. 4C, the adhesive side of the copper table adhering to the front elastomer, Ef. The copper tape is then folded over the sides of the inner elastomer, Ei, as shown in FIG. 4D, thereby adhering the copper tape to the inner elastomer to form shield 190. These aspects relating to shield may be incorporated into any of the embodiments described herein and may include any suitable metallic material suitable for use as an electromagnetic shield.

In another aspect, additional elastomeric components, such as a conductive elastomer within the coupling between the first and second end connectors, shown as Ec in the embodiment of FIG. 4A. This feature may provide additional flexibility and compliance within the electrical connections and/or grounding pathway and may be used in any of the embodiments described herein.

FIGS. 5A-10B illustrated various different embodiments of the compliant mount connector adapter, in accordance with the invention. As can be understood with reference to the figures, the electrical coupling between the first end connector and second end connector may be incorporated into the compliant mount or may extend through the compliant mount. For example, in some embodiments the first end connector and second end connector may be electrically connected through a flexible printed circuit board which may be incorporated into one or more of the compliant mount features described herein, while in other embodiments the first end connector and second end connector may be electrically connected by wires that extend through any of the compliant mounts described herein. It is appreciated that various features described in any of these embodiments may be combined with various other features disclosed herein or may further include various other features known to one of skill in the art not specifically recited herein.

Figure 5A:
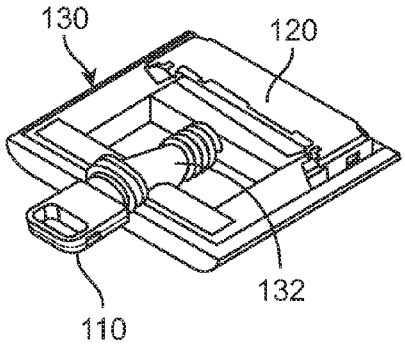
FIGS. 5A-10B show alternative designs of compliant mount connector adapters.

FIGS. 5A-5E depict compliant mount mechanisms that utilize springs or mechanical connections to guide and/or resist movement due to bending or torsional forces. FIG. 5A depicts a compliant mount connector having a compliant mount 132 that includes a spring. The spring may be selected to resist any or all of an axial force, bending force and torsional force applied to the adapter through the first end connector. Utilizing springs fabricated from different materials, gages and length, the resistance of the spring can be controlled to fine tune the strength and rigidity of the adapter as well as the range of movement allowed by the spring. The compliant mount 132 may optionally include an elongate bar attached to the base of the first end connector 110 extending substantially perpendicular to the longitudinal axis of the adapter, as seen in FIG. 5A. The elongate bar between the spring and the first end connector 110 may provide increased resistance to torsional forces and/or bending forces along the plane in which the elongate bar extends, the properties (size, material, modulus of elasticity) of the elongate bar as well as its position and configuration to determine the amount of resistance provided by the elongate bar. The combination of the spring and the elongate bar allows for varying degrees of resistance in response to increases in bending or torsional forces.

Figure 5B:
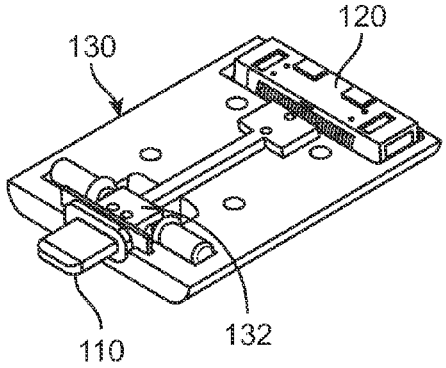

FIG. 5B shows a connector adapter 100 having a compliant mount 132 comprising a torsion bar extending from the first end connector toward the second end connector. The torsion bar provides resistance to both bending and torsional forces applied through the first or second end connectors. The compliant mount 132 may optionally include an elongate bar for providing increased resistance to increased forces, such as the elongate bar in FIG. 5A or a circular bar, such as shown in FIG. 5B to allow increased bending in one or more planes.

Figure 5C:
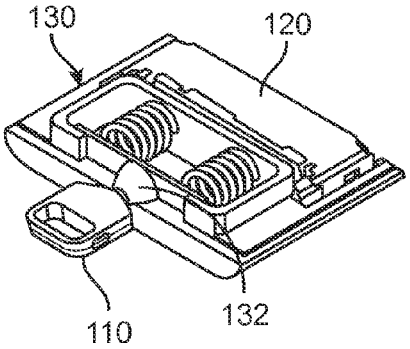

FIG. 5C shows a connector adapter 100 having a compliant mount 132 that includes two springs placed in parallel. Parallel springs may provide increased resistance to bending forces along one or more planes, as well as torsional forces. In addition, as two springs allow for greater distribution of forces, smaller springs or springs having reduced thickness or lower spring constants may be used to provide similar resistive forces as the single spring in FIG. 5A. The first end connector may further include an elongate member, such as those in FIGS. 5A-5B, or may be attached to a relatively thin plate attached to the end of each of the parallel springs. Optionally, the first end connector may be connector through a full-sphere or half-sphere, such as shown in FIG. 5C, so that engagement of the sphere within the cavity of the adapter body 130 guides rotational and bending movement of the first end connector within certain limits so as to control flexibility and compliance of the connectors within the adapter.

Figure 5D:
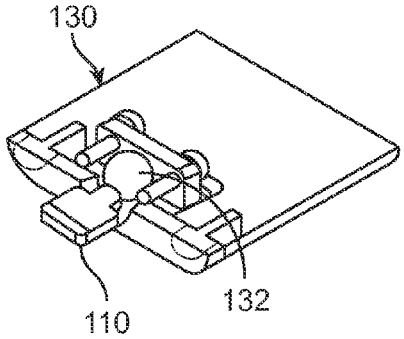

FIG. 5D shows a connector adapter 100 having a compliant mount 132 that includes a friction ball and socket, the first end connector being attached to the sphere and the adapter body being attached to the socket, such that engagement between the sphere and socket guide the rotational and bending movement of the first end connector within the adapter body 130 while friction between the sphere and socket provide resistance to the torsional and bending forces. The amount of resistance provided can be controlled through the geometry, material selection, surface finishing and sizing of the ball and socket. For example, the ball and socket could be configured to allow movement in response to a relatively small amount of rotational/torsional force or bending force, but to provide increased resistance in response to increased levels of force. This may be accomplished by configuring the ball and socket so that once the first end connector is rotated or bent beyond a certain angle, further rotation of the ball and socket meets with increased resistance, such as by use of an oblong sphere.

Figure 5E:
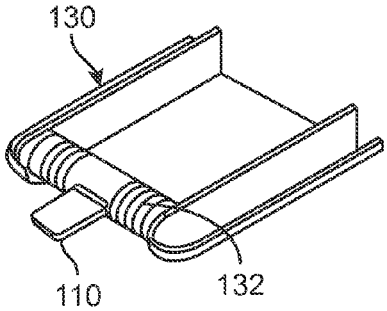

FIG. 5E shows a connector adapter 100 having a compliant mount of a connector adapter that includes an elongate tube extending laterally outward from a base portion of the first connector, the tube coupled with a helical spring to provide increase resistance to bending forces applied through the first connector.

Figure 6A:
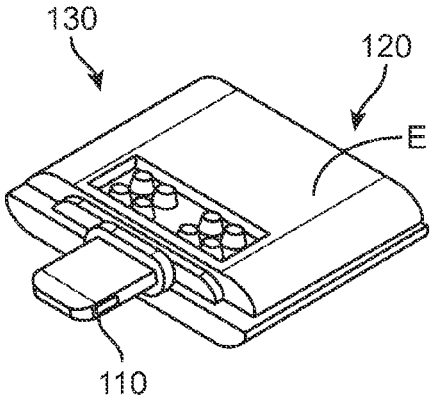
Figure 6B:
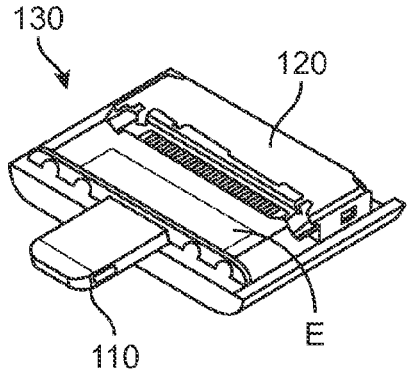
Figure 6C:
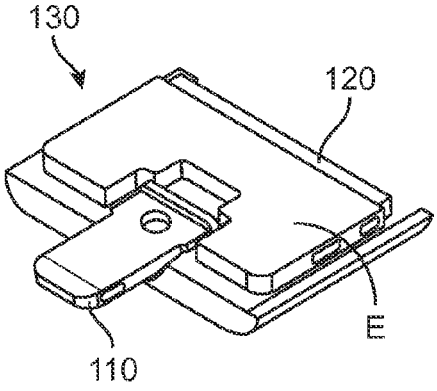
Figure 6D:
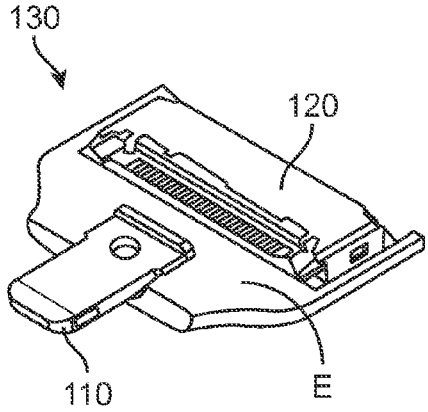
Figure 6E:
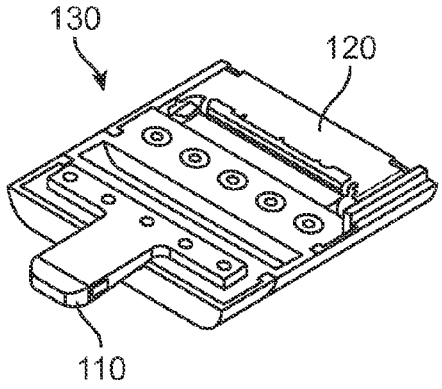

FIGS. 6A-6E depict compliant mounts of connector adapter that utilize elastomeric materials to resist movement due to bending or torsional forces. The internal components may be mechanically fastened to one or more elastomeric components, and the components may be formed of silicone, polyethylene, or various other elastomeric materials. The resistance provided by the elastomer may be controlled by selecting elastomers of certain hardness to provide a desired resistive force. In some embodiments, the resistance of a selected elastomer may be adjusted by including of one or more voids, such as shown in FIG. 6A and FIG. 6E, or by tapering the elastomer E in the area in which reduced stiffness is desired. By forming a void in a waist portion, such as shown in FIG. 6E, the point at which compliant movement occurs within the adapter can be reliably controlled, thereby avoiding unintended movement of certain components to avoid damage to the first and second connectors or the adapter housing. While in one aspect, the elastomer may be overmolded over the internal components and encased within a rigid outer housing, in other embodiments, such as shown in FIGS. 6D and 6E, the elastomer may form a part of or the entire exterior of the connector adapter 100.

FIG. 6A shows a connector adapter 100 wherein the compliant mount comprises an inner elastomer within an exterior rigid shell.

Figure 7A:
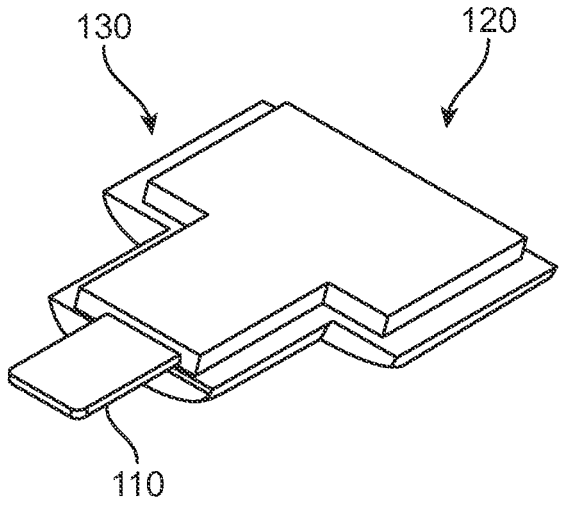
Figure 7B:
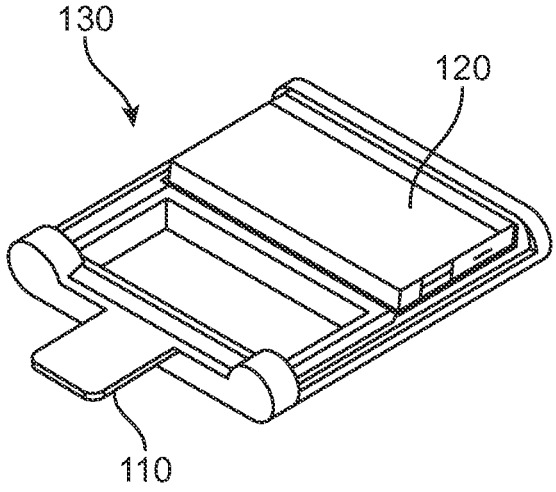

FIGS. 7A-7E depict connector adapter having compliant mounts that utilize elastomer components in addition to rigid materials to provide increased resistance movement due to bending or torsional forces. FIG. 7A shows a connector adapter 100 wherein the compliant mount comprises a tapered rigid housing, while FIG. 7B shows a connector adapter 100 wherein the compliant mount comprises a rigid housing having spaced apart rigid members that in parallel accommodate greater torsional movement while providing resistance to bending or torsional stresses.

Figure 8A:
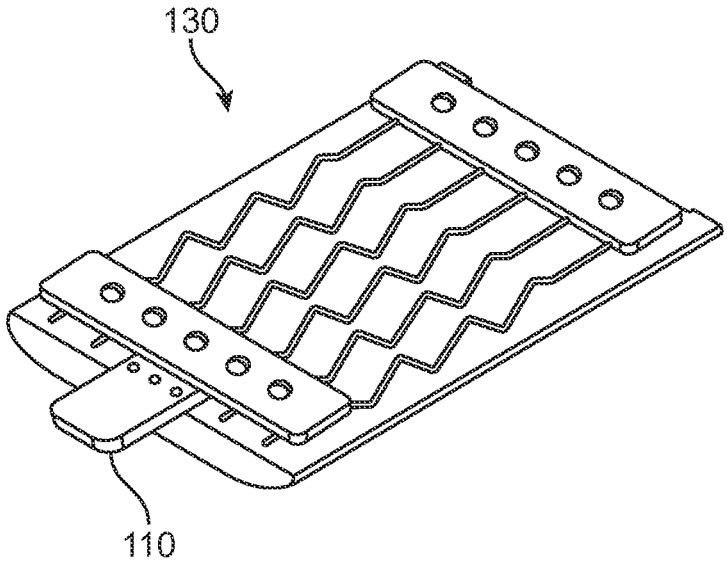
Figure 8B:
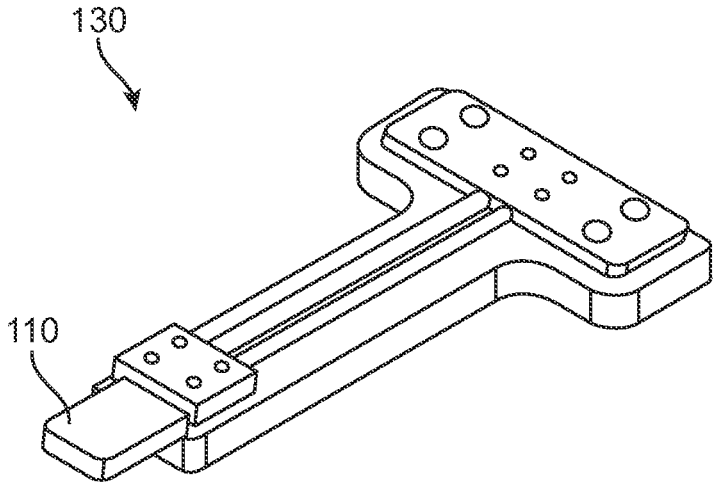

FIGS. 8A-8B depict compliant mount mechanisms that utilize bendable supporting wires to resist movement due to bending or torsional forces. The bendable support wires may be configured to deform elastically, plastically, or a combination of elastic and plastic deformation depending on the magnitude of force applied. FIG. 8A shows a connector adapter 100 wherein the compliant mount comprises a bendable material having a plurality of bendable support wires extending therethrough. The wires may having a high elastic modulus to allow the adapter to be bent within a range of angular displacements in response to bending or torsional forces, or may be configured to have a high plastic modulus so that the adapter could be manually bent into a variety of configurations such that once released the adapter remains in the desired configuration. FIG. 8B shows a similar connector adapter as in FIG. 8A where the bendable wires are concentrated in a central portion extending along the longitudinal axis of the connector adapter so as to function similar to a torsion bar, while still providing the advantages of bendable wire supports described above.

Figure 9:
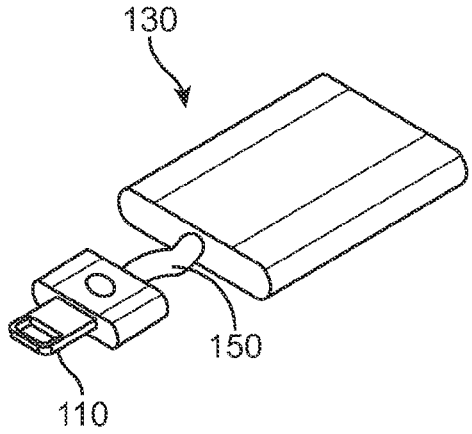

FIG. 9 depicts a compliant mount mechanism that utilizes a stowable dongle to resist movement due to bending or torsional forces. This embodiment is described in more detail in FIGS. 21A-21C.

Figure 10A:
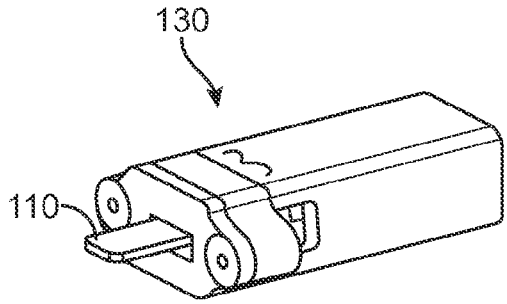
Figure 10B:
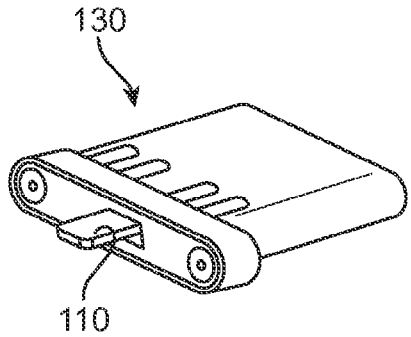

FIGS. 10A-10B depict a compliant mount connector adapter that include one or more internal spring members coupled with two front facing surfaces having detents or protrusion, the detents or protrusions engageable with a corresponding feature on the portable device so as to provide a longer moment arm to withstand bending or torsional forces applied to the adapter through movement of the first portable device, as described herein.

Figure 11A:
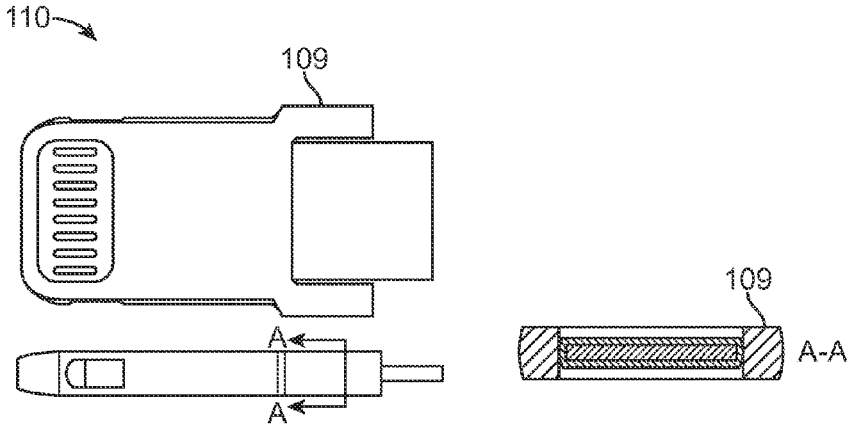
FIGS. 11A-11B illustrate views of differing types of construction of the first end connector of the adapter that provide compliance to the adapter.
Figure 11B:
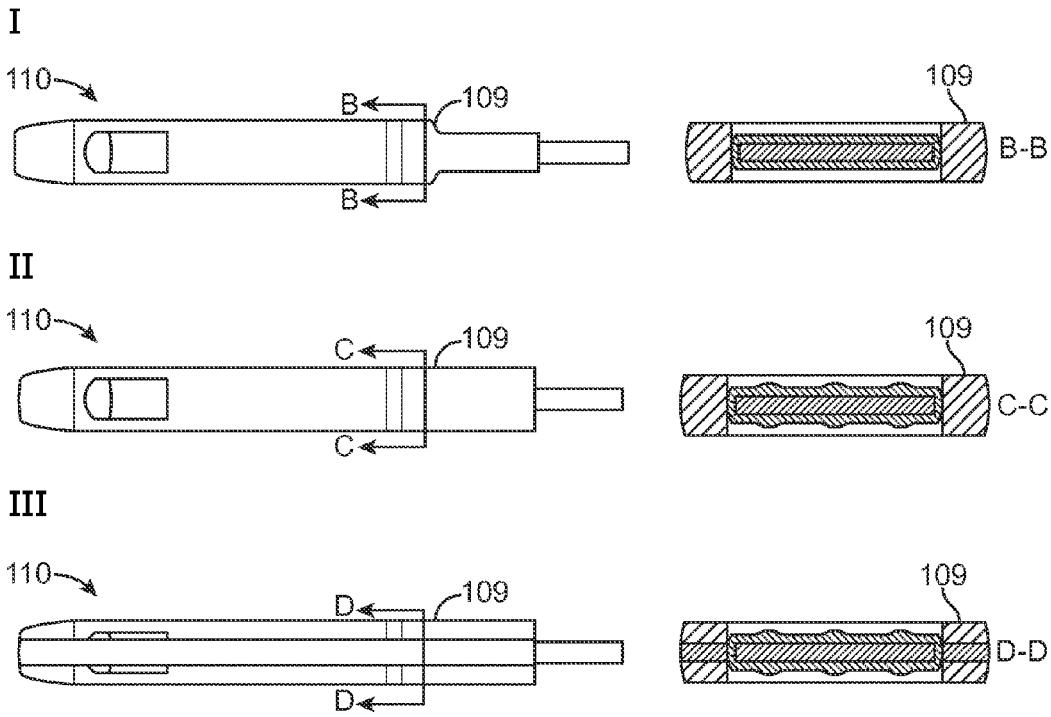

FIGS. 11A-11B depict various designs (I, II and III) of the first connection by which the stiffness and flexibility of the first connector may be controlled. In design A, the stiffness and rigidity of the connector is controlled by adjusting the exterior mounting geometry of the base 109 of the insertable tab 40 of connector 110 (e.g. increasing the width or thickness of the base 109. In design B, the stiffness and rigidity of the connector is controlled by adjusting the internal geometry by which ground ring interfaces with the internal PCB component. In design C, the stiffness and rigidity of the connector is controlled by adjusting the construction of the connector 110, for example constructing the ground ring from layers having differing materials, such as a middle layer having reduced stiffness (darkened portion in cross-section D-D) sandwiched between outer layers of increased stiffness and rigidity.

Figure 12C:
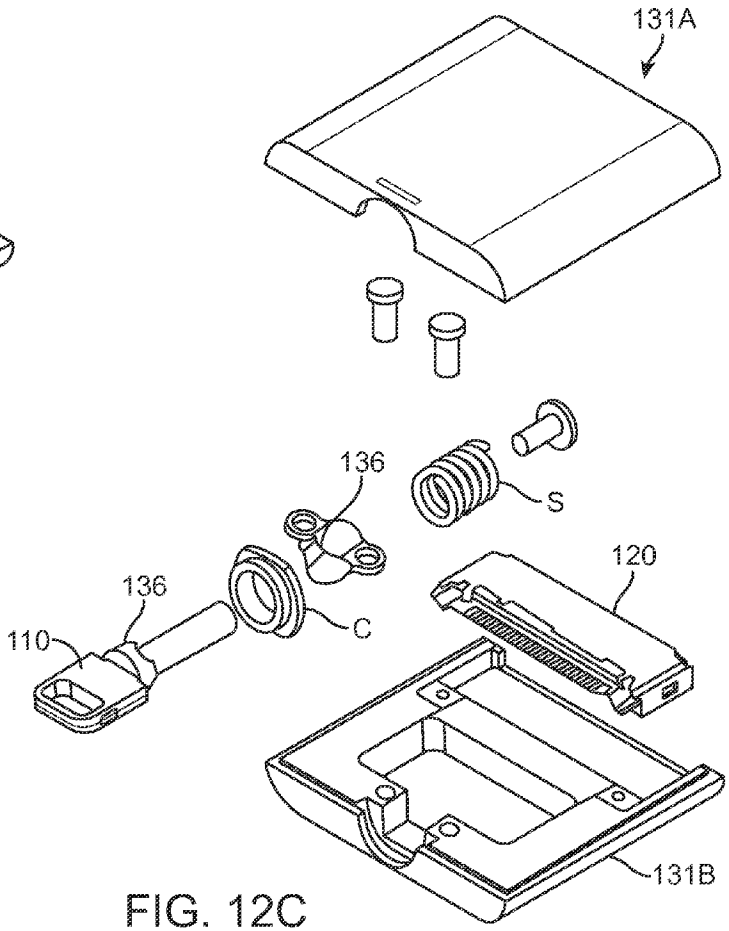
FIGS. 12A-12C show views of an example compliant mount connector adapter utilizing a spring/clutch type compliant mount.
Figure 12A:
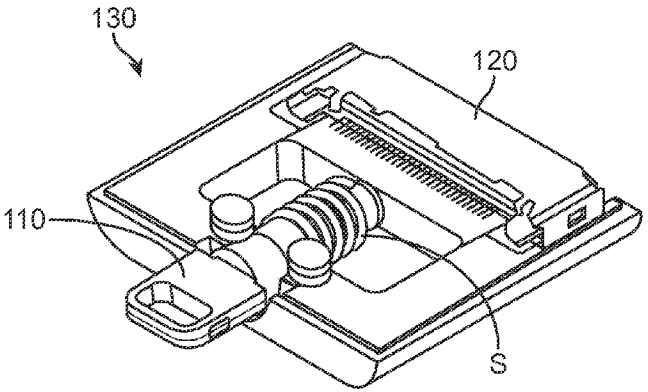
Figure 12B:
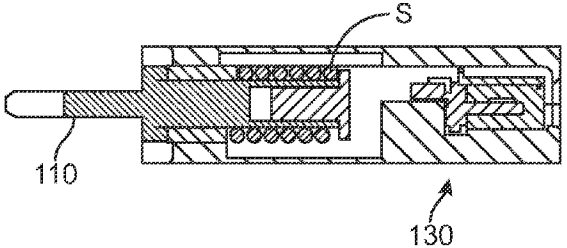

FIGS. 12A-12C depict a perspective view, cross-sectional view, and an exploded view of a compliant mount connector adapter having a spring/clutch design. The compliant mount connecting the first end connection 110 and second end connector 120 includes a compression spring (S) and detent cam 136 assembled within a rigid outer housing, top housing 131A and bottom housing 131B. The detent cam 136 comprises two component having interfacing undulating surfaces, one undulating surface included in a rear-facing base portion of the insertable tab and the other undulating surface included on a second component attached to the bottom housing 131B. A compliant collar (C) may also be used to seat the base portion of the insertable tab 40 into the rigid outer body and may provide additional resistance to bending forces. The undulating portions of the cam surface may be configured so as to provide a desired level of resistance to rotation force, which once exceeded allows the first connector to rotate, while the spring may be used to provide resistance to bending forces.

Figure 13B:
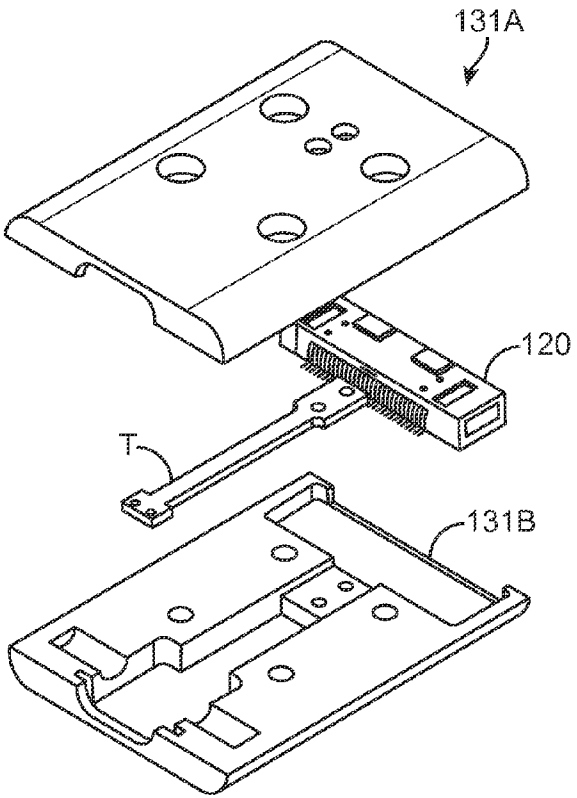
FIGS. 13A-13B show views of an example compliant mount connector adapter utilizing a torsion bar.
Figure 13A:
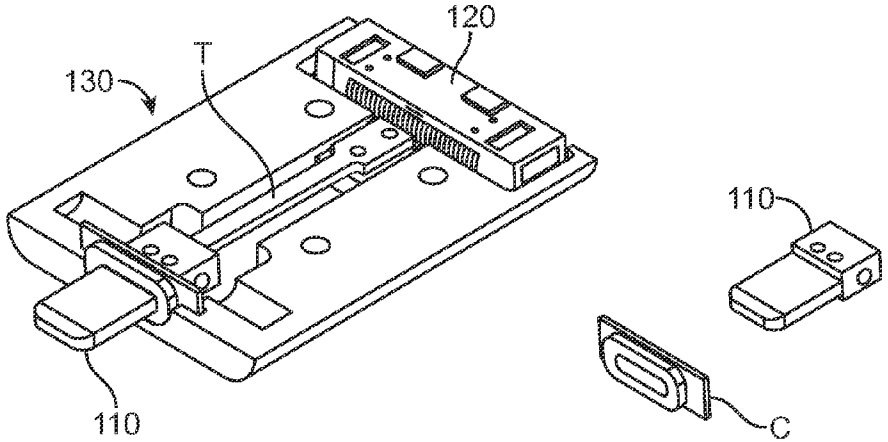

FIGS. 13A-13B depict a perspective view and an exploded view, respectively, of a compliant mount connector adapter having a torsion bar design. The adapter body 130 may include a top and bottom rigid housing 131A, 131B and an internal torsion bar (T) coupling the first and second connectors providing resistance to both bending and torsional forces. In addition, a compliant collar (C) may be used where the insertable tab 40 seats within the rigid outer body to provide additional resistance to bending forces. The collar (C) may also be used to move the pivot point away from the first connector by selecting a collar of a material of sufficient hardness or stiffness.

Figure 14B:
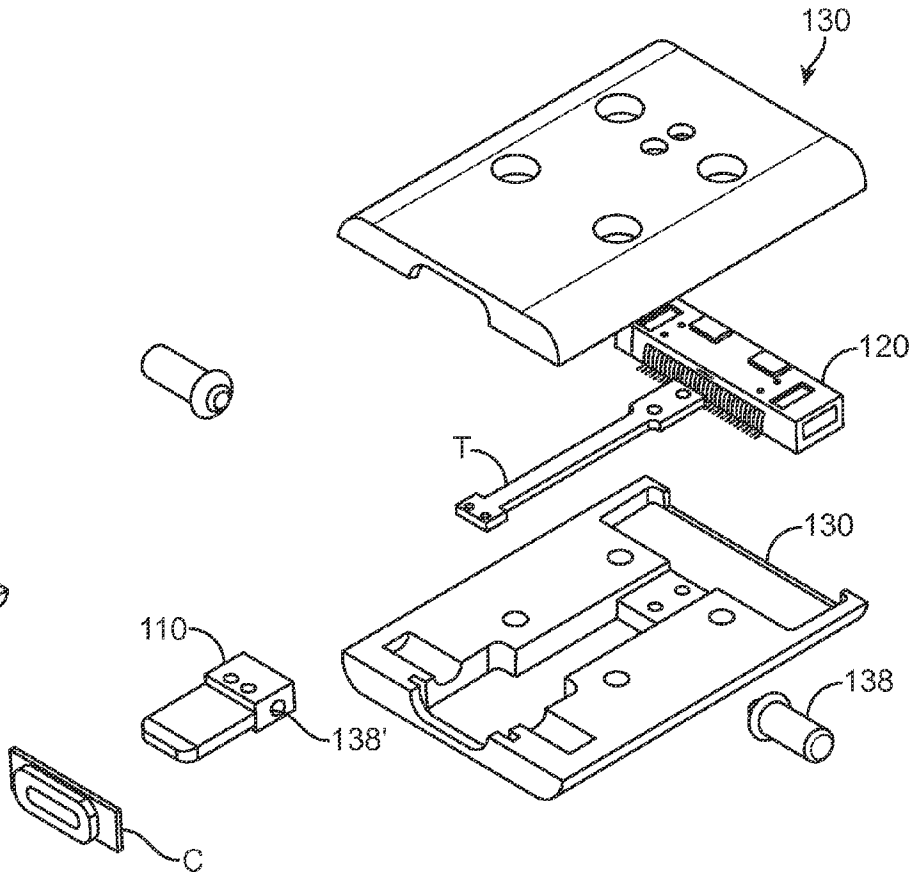
FIGS. 14A-14B show views of an example compliant mount connector adapter utilizing a torsion bar and spring plungers.
Figure 14A:
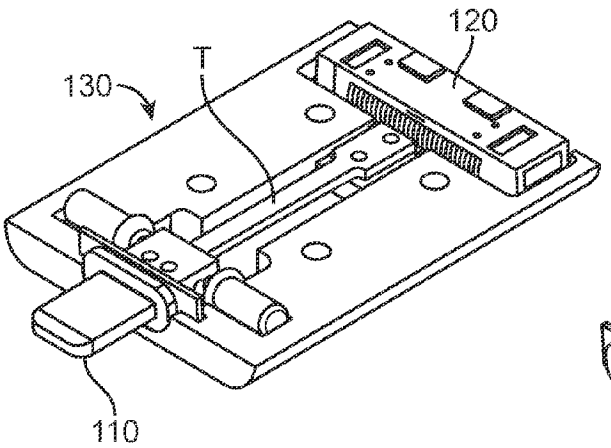

FIGS. 14A-14B depict a perspective view and an exploded view, respectively, of a compliant mount connector adapter having a torsion bar design, similar to that in FIGS. 13A-13B, that further includes spring plungers 138 engaged within spring plunger detents 138' in each side of a base portion of the connector 110. The spring plungers 138 extend laterally outward so as to provide increased resistance to torsional forces while allowing rotation of the spring plunger to accommodate movement of the first connector 110 associated with displacement from bending movement. The resistive force provided by this configuration is related to the spring force of the spring plungers as well as the dimensions of each.

Figure 15A:
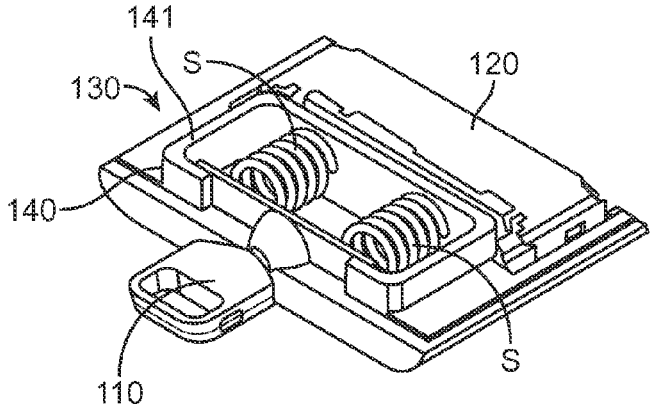
FIGS. 15A-15B show views of an example compliant mount connector adapter utilizing a spherical pivot.
Figure 15B:
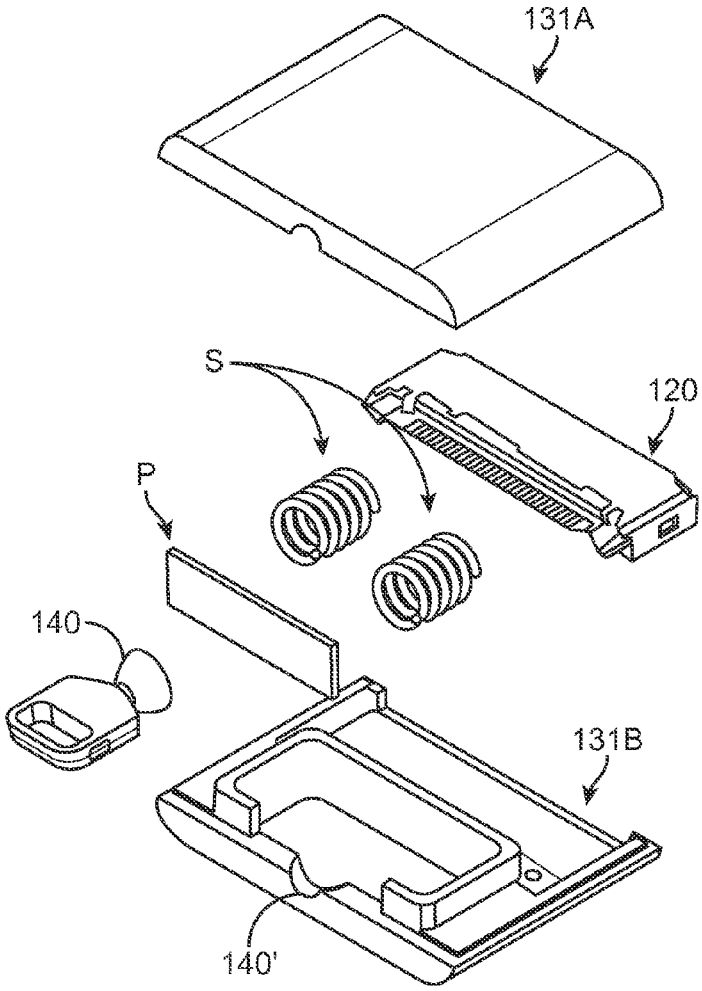

FIGS. 15A-15B depict a perspective view and an exploded view, respectively, of a compliant mount connector adapter having a spherical pivot. The base of the insertable tab 40 of connector 110 is attached to a spherical or semi-spherical component 140 that is in turn attached to a laterally extending plate 141 that distributes applied forces to a pair of springs attached underneath plate 141. The laterally extending plate 141 distributes the forces along the length of the adapter to the pair of springs inhibit torsional and bending movement, while the spherical component 140 is interfaced within a spherical seating 140' in the bottom rigid housing 131B so as to guide movement of the first connector to control the point at which movement of the first connector 110 pivots.

Figure 16A:
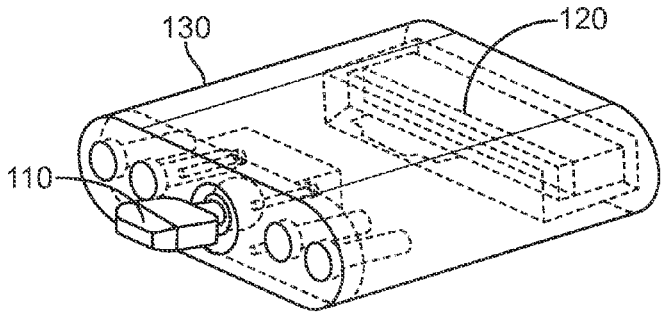
FIGS. 16A-16B show views of an example compliant mount connector adapter utilizing a ball and socket.
Figure 16B:
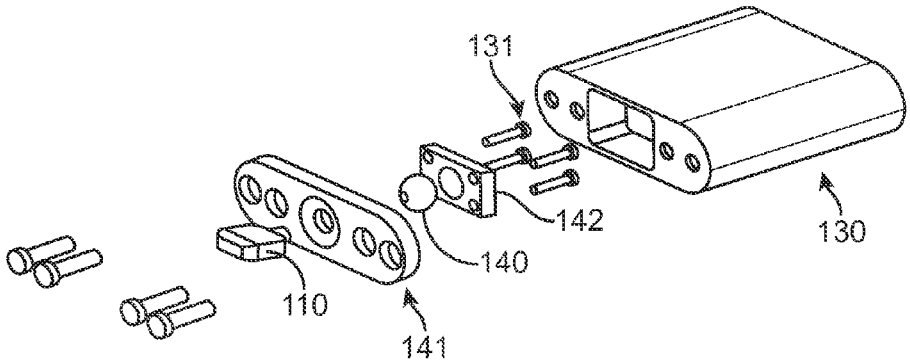

FIGS. 16A-16B depict a perspective view and an exploded view, respectively, of a compliant mount connector adapter having a ball and socket. The base of the insertable tab 40 of connector 110 is attached to a spherical component 140 that is seating against a frictional adjustment plate 142 having a spherical surface engaged against the spherical component and held in place by a front plate 141 through which the base portion of the connector 110 extends and attached to the spherical component 140. The resistance of both the bending and torsional forces is provided primarily by the friction between the spherical component and the frictional adjustment plate.

FIGS. 17A1-17C2 depict various views of compliant mount connector adapter having one or more helical springs used to couple a rotatable tube 144 extending laterally at an end of the adapter body 130 near the first end connector 110. In some embodiments, the tube is rotatably attached to a structure frame 146 using a helical spring S at each end of tube 144, the structural frame insertable into a rigid housing of adapter body 130. The tube 144 may be configured to rotate within a desired range of movement, such as 90 degrees or less in each direction from the upright position shown in FIGS. 17A-1, such as about 45 degrees in each direction. In some embodiments, a helical spring wraps around each end of tube 144 and is coupled to the tube 144 near where the first end connector 110 extends from tube 144, such as by a weld or rigid attachment, while the other end of the springs attach to the structural frame 146 at points 147, as shown in the exploded view of FIGS. 17A-2. An end collar 121 may be used to secure the second end connector (not shown) within the adapter body 130 housing.

Figures 1, 17A:
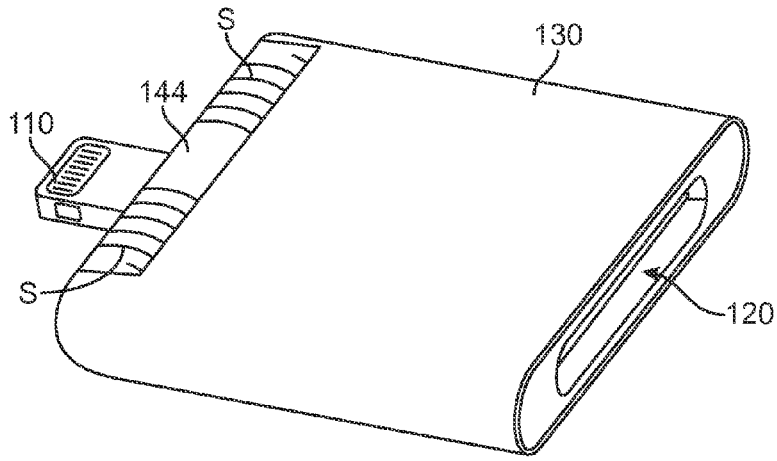
FIGS. 17A1-17C2 show views of an example compliant mount connector adapter utilizing a torsion spring.
Figures 2, 17A:
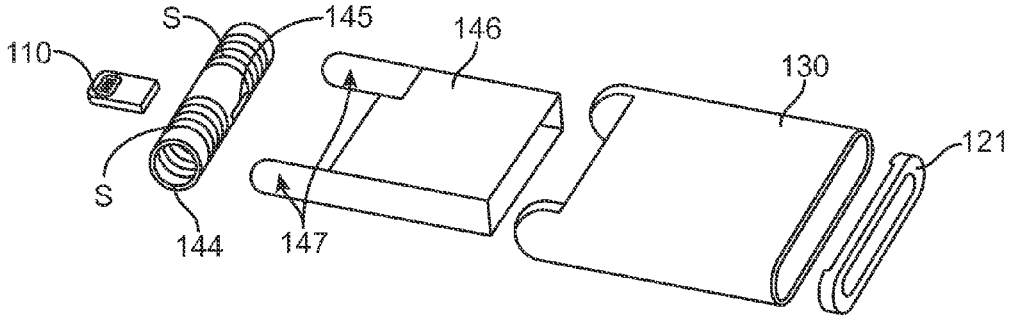
Figures 1, 17B:
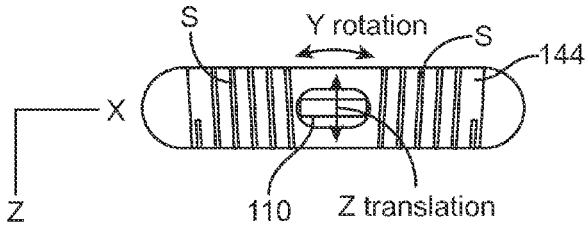
Figures 3, 17B:
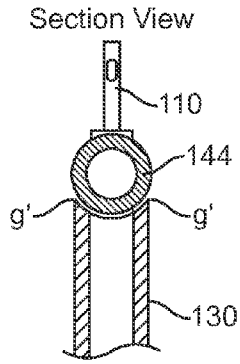
Figures 2, 17B:
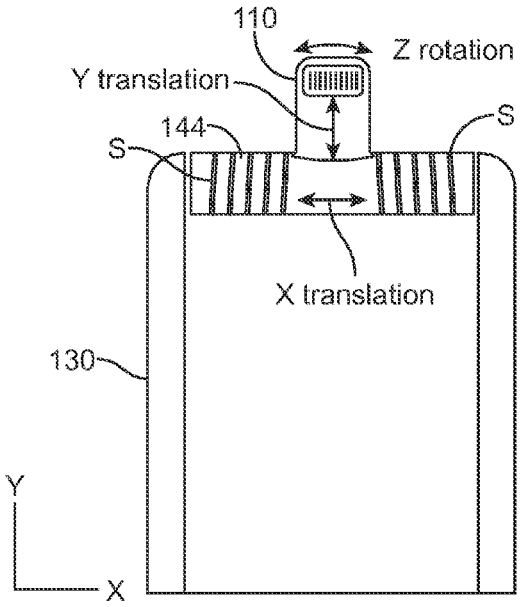
Figures 4, 17B:
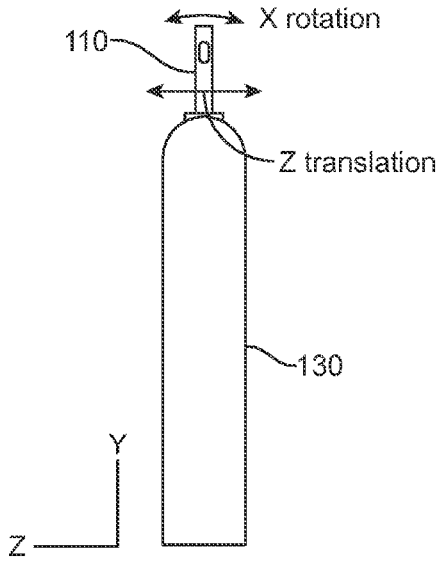
Figures 1, 17C:
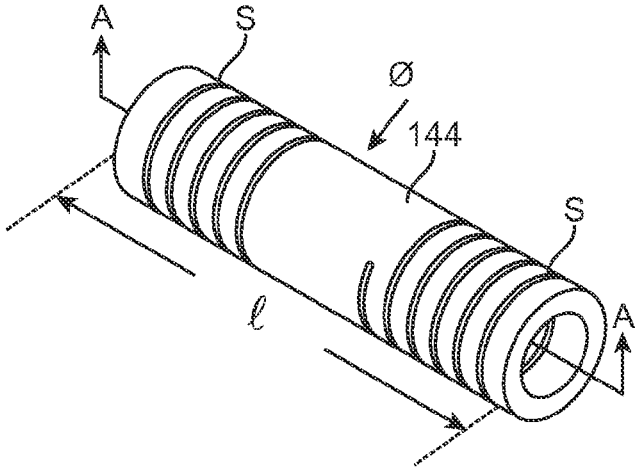
Figures 2, 17C:
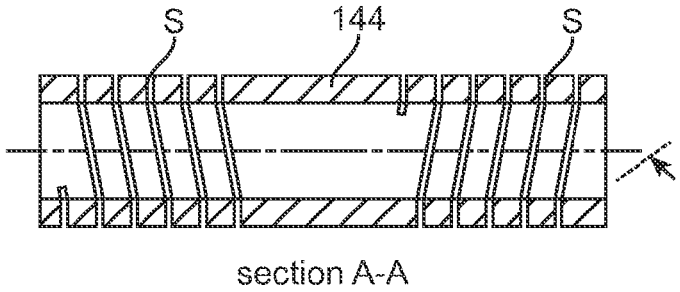

As shown in FIGS. 17B1-17B-4, a compliant mount connector utilizing one or more helical springs as described above may provide six-degrees of freedom. The rotation of the tube 144 provide rotation along the X-axis, while gaps between each helical spring and the structural housing 146 and the rigid housing of the adapter body allow additional degrees of freedom to provide rotation along the Y and Z axes, as well as translation along the Y and Z axes. The amount of translation and rotation along each axis can be controlled by the spacing between the tube 144 and associated helical springs and the structural frame 145, as well as by the material properties and dimensions of each spring (e.g. spring constant). In the embodiments shown, the tube 144 is configured so that its length, l, extends almost the entire width of the adapter body 130 so as to distribute forces applied to the adapter through the structural frame 145. In some embodiments, the tube is a hollow tube fabricated of a rigid material, such as stainless steel, and has a length of about 24.4 mm and a diameter of about 6.8 mm. Each helical spring may wrap around each end of the tube 144 and attach to the tube 144 near a central portion so as to allow for the additional movement and degrees of freedom described above. FIGS. 17C-1 and 17C-2 illustrate a perspective and cross-sectional view of an example tube having two helical springs attached at each end.

Figure 18:
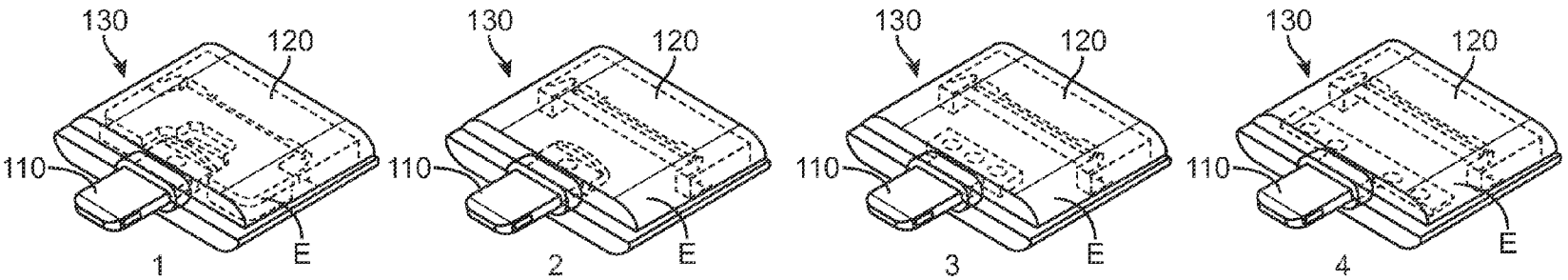
FIGS. 18-19 show example compliant mount connector adapter utilizing an elastomer.
Figure 19:
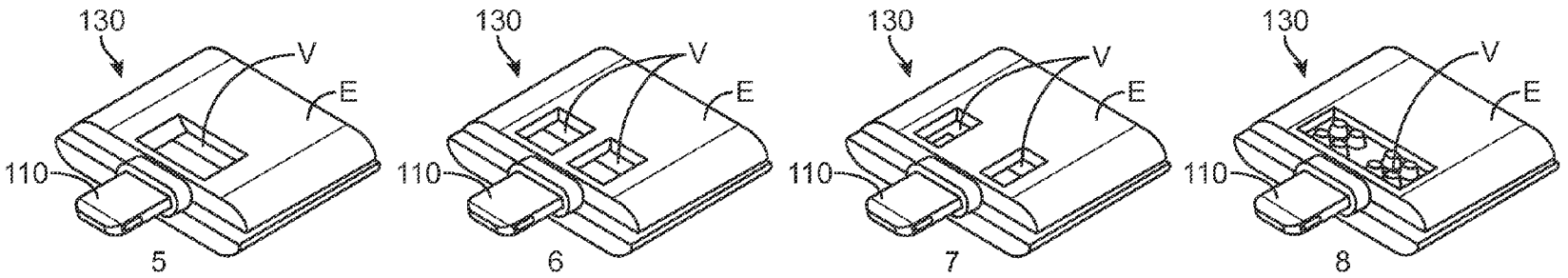

FIGS. 18-19 show various embodiments of compliant mount connector adapters that use an elastomer component within the adapter body 130 to provide resistance to bending and torsional forces. In some embodiments, the elastomer E substantially fills the entire cavity within a rigid shell of the adapter body 130. A base portion of the connector 110 may be mechanically fastened to the elastomer, such as in designs 1-4 of FIG. 18, and may be fastened by a bar that extends laterally outward, such as in designs 3 and 4, so as to distribute torsional forces applied through the first connector. In other embodiments, the elastomer E may be overmolded over a portion of the first or second connector internal to the adapter body 130, thereby obviating the need for additional mechanical fastening, such as shown in designs 5-8 of FIG. 19. In addition, when overmolding the elastomer E, voids (v) may be included to provide for more consistent uniform injection of the overmold material or to adjust or vary the stiffness of the elastomer in certain portions. For example, including one or more voids in a portion of the elastomer would generally reduce the stiffness in that area, thereby varying the resistive force provided by the elastomer E and controlling the location of a pivot point about which compliant movement occurs.

Figure 20A:
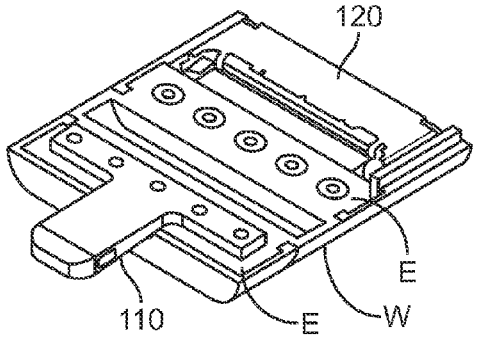
FIGS. 20A-20C show views of an example compliant mount connector adapter utilizing an elastomer with a waist portion.
Figure 20B:
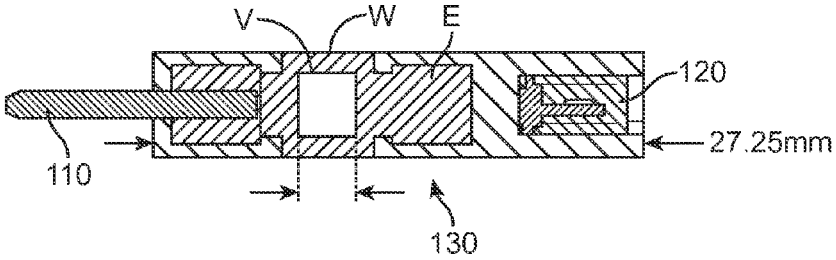
Figure 20C:
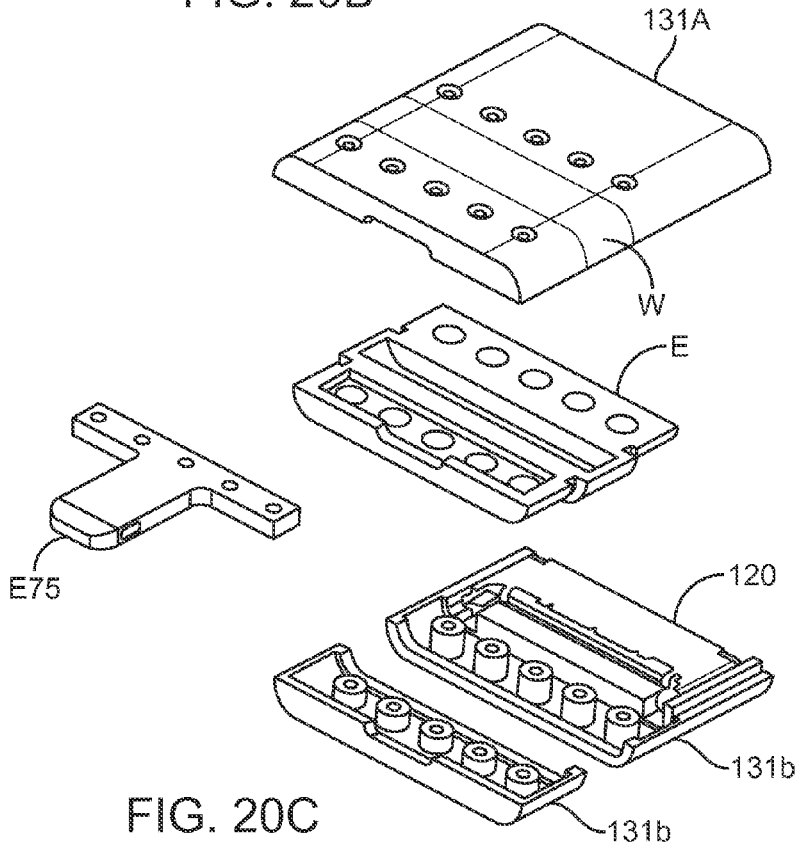

FIGS. 20A-20C depict various views of a compliant mount connector adapter having an elastomer portion with a waist portion in a mid-section of the elastomer. A mid-section of the elastomer includes a void, which reduces the resistance provided by the elastomer in the waist portion so that pivotal movement of the adapter in response to bending forces occurs at or near the waist portion, sufficiently away from the first connector, thereby avoiding damage to either the first end connector or second end connector. In addition, each of the top and bottom rigid housing components 131A, 131B may include two components attached to the elastomer on opposite sides of the waist portion so that the elastomer disposed at the waist portion forms the exterior surface of the compliant adapter. This configuration avoids cosmetic or structural damage to the rigid housing as the compliant movement in response to bending occurs primarily at the waist portion of the elastomer.

Figure 21A:
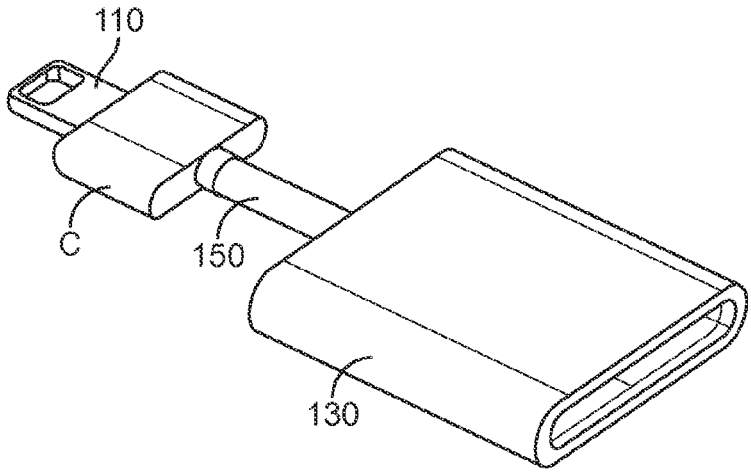
FIGS. 21A-21C show views of an example compliant mount connector adapter utilizing a stowable dongle.
Figure 21B:
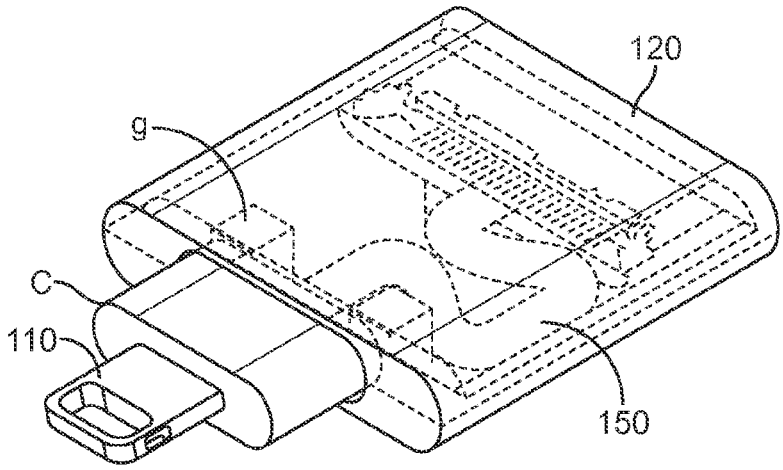
Figure 21C:
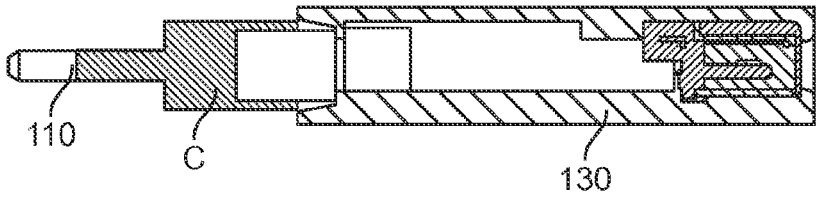

FIGS. 21A-21C depict perspective views and a cross-sectional view of a compliant mount of a connector adapter that utilizes a dongle 150 or short cord that is stowable within the adapter body 130. A base portion of the first connector releasably attached to a rigid housing of the adapter, such as in a friction or interference fit. Once the force provided by the friction fit is overcome, by bending or torsional force, the first connector releases yet remains electrically coupled and attached to the adapter through a short dongle 150 or short cord stored within an internal void in the adapter body 130. The internal cavity of the adapter body 130 in which the dongle cord 150 is stored may further include one or more guide blocks (g) which may be positioned to assist in storage and movement of the dongle cord 150 when deployed. This feature prevents cosmetic or structural damage to the adapter while still allowing the portable device to remain electrically coupled to the other electronic device through the stowable dongle 150. Once the dongle 150 is deployed a user can easily push the dongle 150 back into the void of the adapter body 130 and restore the friction fit of the first connector by manually inserting the collar C of first connector plug into the adapter body 130, thereby allowing the adapter to function as a supporting mount for the portable device. This feature has an additional advantage in that the adapter can function as a short corded adapter in which mounting of the portable device is not required, particularly useful in connecting larger devices, and allowing the adapter to be used as a mounting adapter so that a portable device can be mounted onto the other electronic device.

While this invention has been described in terms of various embodiments, there are alterations, permutations, and equivalents, which fall within the scope of this invention. For example, although the invention has been described in terms of a portable electronic device, it should be appreciated that certain features of the invention may also be applied to various other types of connections between devices and mounting of various other components, in accordance with the spirit and scope of the invention. While the above is a complete description of various embodiments of the invention, it is appreciated that various alternatives, modifications, and equivalents may be used and any of the features described in different embodiments may be combined in accordance with the spirit and scope of the invention.

What is claimed is:

1. A connector adapter for connecting a first electronic device with a second electronic device, the connector adapter configured to enable data and power transmission between the electronic devices, the connector adapter comprising:

a plug connector configured for removable mating engagement within a connector of the first electronic device, the plug connector having a base portion and an insertable tab that extends away from the base, the insertable tab having a plurality of external contacts formed thereon to enable data and power transmission through the plug connector;

a receptacle connector configured for removable mating engagement with a connector of the second electronic device, the receptacle connector having a plurality of interior contacts to enable data and power transmission through the receptacle connector;

an adapter body through which the plug connector and receptacle connector are connected by circuitry within the adapter body configured to enable data and power transmissions between the plug connector and the receptacle connector; and a compliant mount within the adapter body, the compliant mount operatively coupled to the plug connector to allow movement of the plug connector relative to the receptacle connector, the compliant mount including a front elastomer that surrounds a base portion of the tab and abuts a laterally extended portion of the plug connector and an inner elastomer disposed between the receptacle connector and the front elastomer, wherein the front elastomer has a first hardness and the inner elastomer has a second hardness less than the first hardness such that a majority of compliant movement within the compliant mount in response to bending forces applied on the plug connector occurs within the inner elastomer.

2. The connector adapter of claim 1 wherein the insertable tab extends distally away from the base along a longitudinal axis and the front elastomer is configured to slide over the first insertable tab and abut against a distal facing surface of the laterally extending portion.

3. The connector adapter of claim 1 wherein the laterally extending portion of the plug connector extends laterally from the longitudinal axis in opposite directions and the inner elastomer substantially circumscribes the laterally extended portion when received therein.

4. The connector adapter of claim 3 wherein the inner elastomer comprises a distally opening cavity dimensioned to fittingly receive the laterally extending portion of the plug connector.

5. The connector adapter of claim 4 wherein the laterally extending portion has a cross-section perpendicular to the longitudinal axis that is an elongate shape.

6. The connector adapter of claim 5 further comprising:

a second shield slidable over a printed circuit board component of the receptacle connector to shield the printed circuit board component from electromagnetic interference.

7. The connector adapter of claim 6 wherein the second shield is dimensioned to interface with and abut against the inner elastomer.

8. The connector adapter of claim 7 wherein the first shield extends at least partially over the second shield.

9. The connector adapter of claim 4 wherein the elongate shape is an ellipsoid with pointed ends.

10. The connector adapter of claim 1 further comprising:

a first shield at least partially surrounding a printed circuit board component of the plug connector that shields the plug connector from electromagnetic interference, the first shield comprising a thin bendable metallic layer extending at least partially surrounding the inner elastomer.

11. The connector adapter of claim 10 wherein the first shield is adhesively bonded to the inner elastomer.

12. The connector adapter of claim 10 wherein the first shield substantially surrounds the inner elastomer and is disposed between the inner elastomer and the front elastomer.

13. The connector adapter of claim 1 further comprising:

a rigid outer housing disposed about the compliant mount that provides increased rigidity and limits compliant movement of the compliant mount.

14. The connector adapter of claim 13 wherein the rigid outer housing comprises a hard shell substantially circumscribing the compliant mount.

15. The connector adapter of claim 13 wherein the first configuration comprises an eight-pin connector and wherein the second configuration comprises a 30-pin connector.

16. The connector adapter of claim 1 further comprising:

one or more rigid shim plates extending alongside the inner elastomer between the inner elastomer and the rigid housing that further increase rigidity and limit compliant movement of the compliant mount.

17. The connector adapter of claim 16 wherein the one or more rigid shim plates are disposed between the rigid housing and a first shield applied over the inner elastomer.

18. The connector adapter of claim 16 wherein the one or more shim plates include at least two shim plates on opposite sides of the inner elastomer.

19. The connector adapter of claim 16 wherein the adapter body has a length sufficient to extend the plug connector above a docking well of the docking station in which the receptacle connector is disposed when matingly engaged with the docking station to allow coupling of a portable device with the docking station when the docking well is of insufficient size to receive the portable device.

20. The connector adapter of claim 16 wherein the shore hardness of the front elastomer is between 10% and 100% greater than that of the inner elastomer.

21. The connector adapter of claim 1 wherein the first electronic device is a portable electronic device and the second electronic device comprises an adapter or docking station.

22. The connector adapter of claim 1 wherein the plurality of electrical contacts of the plug connector are arranged in a first configuration and the plurality of electrical contacts of the receptacle connector are arranged in a second configuration different from the first configuration.

23. The connector adapter of claim 1 wherein the front and inner elastomers each have a shore hardness between 27 D and 72 D.

24. The connector adapter of claim 1 wherein the front elastomer includes a substantially flat portion that abuts against the inner elastomer or a shield disposed thereon and a collar portion that circumscribes the base portion of the insertable tab.

25. The connector adapter of claim 1 wherein the inner elastomer is substantially rectangular and includes an axial passageway therethrough, the axial passageway being adapted to fittingly receive the laterally extended portion of the connector plug.

26. The connector adapter of claim 1 wherein one or both of the front and inner elastomer includes a portion having one or more voids that provide increased flexibility at or adjacent the portion.

27. The connector adapter of claim 1 wherein the inner elastomer comprises a plurality of bendable wires that provide increased rigidity and control over compliant movement therethrough.

28. A compliant mount for use in connecting two electronic devices so as to allow relative movement between a first and second electronic device when connected, the compliant mount comprising:

a housing;

a first and second connector of differing type coupled to the housing and configured for removable mating engagement with corresponding connectors of the first and second electronic devices, respectively, to enable data and power transmission between the first and second electronic devices when connected, each of the first and second connectors having a plurality of electrical contacts;

a front elastomer adjacent the first connector, the front elastomer having a first hardness;

an inner elastomer disposed within the housing between the front elastomer and the second connector, the inner elastomer having a second hardness;

wherein the front elastomer and inner elastomer, in combination, provide sufficient flexibility in response to a force applied to the first connector to accommodate compliant movement of the first connector relative to the second connector within a desired range of movement along one or more axes and further provide sufficient rigidity to support the first connector and inhibit compliant movement of the first connector relative to the second connector outside the desired range of movement which is within an angular displacement of 90 degrees from a mounted plane along which the first connector extends, wherein the second hardness is less than the first hardness so that a majority of compliant movement occurs within the inner elastomer.

29. The connector adapter of claim 28 wherein the desired range of movement is within an angular displacement of about 45 degrees from the mounted plane along which the first connector extends.

30. A connector adapter for connecting a first electronic device with a second electronic device, the connector adapter configured to enable data and power transmission between the electronic devices, the connector adapter comprising:

a first end connector and second end connector, the first end connector including a plurality of electrical contacts disposed in a first insertable tab to enable data and power transmission therethrough and being configured to enable said data and power transmissions to pass between the first electronic device and the second end connector, the first insertable tab configured for removable mating engagement within a connector receptacle of the first electronic device, and the second connector including a plurality of electrical contacts arranged within a connector receptacle in the connector adapter to enable data and power transmission therethrough and being configured to enable said data and power transmissions to pass between the second electronic device and the first end connector, the second end connector further configured for removable mating engagement with a second insertable tab of the second electronic device, thereby enabling said data and power transmissions to pass between first electronic device and the second electronic device when the connector adapter is matingly engage with each of the first and second electronic devices; and an adapter body through which the first end connector and second end connector are connected, wherein the adapter body includes:

a compliant mount, the compliant mount being sufficiently flexible to allow relative movement of the first end connector relative to the second end connector and sufficiently rigid to support the first end connector when the second end connector is matingly engaged with the second electronic device, wherein the compliant mount includes a front elastomer surrounding a base portion of the first insertable tab and an inner elastomer disposed between the second end connector and the front elastomer, the front elastomer has a hardness greater than that of the inner elastomer so that a majority of the compliant movement occurs within the inner elastomer.

* * * * *